United States Patent [19]

Turner

[11] 4,338,849

[45] Jul. 13, 1982

[54] ELECTRONIC TRANSFER ORGAN

[76] Inventor: William D. Turner, 12804 Cedarbrook La., Laurel, Md. 20811

[21] Appl. No.: 293,273

[22] Filed: Aug. 17, 1981

Related U.S. Application Data

[63] Continuation-in-part of Ser. No. 44,071, May 31, 1979, abandoned.

[51] Int. Cl.[3] ..... G10H 1/00

[52] U.S. Cl. ..... 84/345; 84/1.01; 84/1.19; 84/124; 84/DIG. 26; 84/DIG. 4; 84/DIG. 1

[58] Field of Search ..... 84/1.01, 1.03, 1.19, 84/1.24, 345, DIG. 4, DIG. 26, DIG. 1

[56] References Cited

U.S. PATENT DOCUMENTS

| | | | |
|---|---|---|---|
| 3,647,928 | 3/1972 | Turner | 84/DIG. 4 |
| 3,809,792 | 5/1974 | Deutsch | 84/1.24 |
| 3,978,755 | 9/1976 | Woron | 84/DIG. 4 |
| 4,012,982 | 3/1977 | Southard | 84/1.24 |
| 4,027,101 | 5/1977 | Defrettas et al. | 84/DIG. 26 |
| 4,033,219 | 7/1977 | Deutsch | 84/1.24 |
| 4,063,034 | 12/1977 | Peters | 84/DIG. 26 |
| 4,099,439 | 7/1978 | Luce | 84/1.24 |
| 4,109,208 | 8/1978 | Tomisawa et al. | 328/13 |
| 4,111,092 | 9/1978 | Adachi | 84/1.24 |
| 4,112,803 | 9/1978 | Deutsch | 84/DIG. 4 |
| 4,128,032 | 12/1978 | Wada et al. | 84/1.19 |
| 4,143,327 | 3/1979 | Welsh | 84/1.19 |
| 4,147,083 | 4/1979 | Woron et al. | 84/1.01 |

*Primary Examiner*—S. J. Witkowski
*Assistant Examiner*—Forester W. Isen
*Attorney, Agent, or Firm*—Henry C. Nields

[57] ABSTRACT

The present invention relates to economically fabricated means for the generation and processing, member selection, and acoustic radiation of pluralities of individual tone currents originating from at least one high frequency source and formed by note-information temporarily transferred through key depression, from permanent electronic memories to temporary memories in small numbers of standard tone units, in precise duplication of properties of pipe organ sound.

There is described an electronic transfer organ for duplicating twenty-six known properties of pipe organ sound. The illustrative, inventive instrument employs completely standardized circuitry except for automatically programmable memories for each organ voice, which contain all the information required to form, switch and variously decouple all the notes in that voice. When keyboard keys are depressed, the information for corresponding notes is transferred to temporary memories in small numbers of tone units which then generate and switch the individual notes, without recourse to separate and permanent individual circuitry for each note. Dynamic keyers duplicate the keying effects of tracker action pipe organs. Sigmoid switches impart individualized tonal attack and decay patterns which preserve smooth keying at all speeds. All tone frequencies, derived ultimately from at least one high frequency source, are randomly independent in phase, and remain permanently in the various degrees of optimal mistune which characterize organ pipes in good tune. A four-channel sound system implements the effects of the tone frequency decouplings, and of a plurality of multiresonant filter sets, which together duplicate the collective sound of organ pipes distributed in various arrays within pipe enclosures. Construction is modular by keyboard and associated elements. Keyboard modules are subject to intercoupling by electronic or other means, and to augmentation by various devices in the prior art which effect expressive playing and moderate and musical fluctuations of tones, which are characteristic of organ pipe sound.

15 Claims, 15 Drawing Figures

ELECTRONIC TRANSFER ORGAN

This is a continuation-in-part of application Ser. No. 044,071, filed May 31, 1979, now abandoned.

BACKGROUND OF THE INVENTION

Arrays of many pipes, their keying actions, enclosures, and wind sources lend pipe organ sound at least twenty-six properties which distinguish it from the sound of most prior art electronic organs (cf. William D. Turner, Basic musical differences between pipe organs and contemporary electronic organs. Laurel, Md., 1979). Of eight electronic organs in the prior art, thirteen duplicate only a single property, four duplicate only six properties, and only one duplicates as many as nine properties. One digital organ in the prior art (cf. Deutsch: U.S. Pat. No. 3,515,792), which is said to be "capable of reproducing accurately all of the . . . tonal qualities of an air driven pipe organ", actually duplicates only one of the twenty-six properties of pipe organ sound. Another prior art electronic organ which contained hundreds of individual tone frequency oscillators did not prove competitive with pipe organs and other electronic organs. The prior art actually discloses no practical electronic equivalent of pipe organs' many individual tone sources. Such sources are quite numerous as a rule, individual in waveform, independent in phase, variously responsive to keying, spatially dispersed, variously decoupled acoustically, and in various degrees of optimal mistune. Most prior art electronic organs employ only twelve basic tone sources whose frequencies are exactly divided to generate different octaves. The resulting tone currents are then variously waveformed to produce nominally different organ voices. The integral relations between the tone current frequencies for different octaves, the identities of corresponding frequencies in the different voices, and the monophonic circuitry and sound systems employed in such prior art organs, together preclude the distinctive identities of concurrently sounding octaves or voices, and the particular resulting chorus and related effects, which together are characteristic of pipe organs. None of the means for simulating or approximating such characteristics, which some prior art electronic organs employ, duplicates the effects of pipe organs.

SUMMARY OF THE INVENTION

The invention comprehends an electronic organ which generates any required numbers and kinds of individual, distinctive notes whose acoustical and musical properties duplicate those of pipes in pipe organs of any type or size. The duplication is effected without recourse to permanent individual circuits for individually generating, switching and decoupling each separate note. Instead, large memories for each organ voice are first automatically and permanently or quasi-permanently stored with all the information required to generate, switch, optimally mistune, and decouple all the individual notes of that voice. Initial depression of keyboard keys causes such information corresponding to the depressed keys to be transferred from selected fields of the large voice memories to small temporary memories in small numbers of standard tone generating units for each voice. The transferred information presets each unit's other elements to generate an individualized optimally mistuned note, to switch it on and off in individual ways appropriate to that note, and to uncouple it variously from other concurrently sounding notes so as to duplicate the effects of various acoustic decouplings between spatially dispersed organ pipes. The illustrative circuitry just indicated is at once digital and standardized. It can be implemented with discrete digital components or with standard or custom integrated digital circuits of any scale. The illustrative instrument which discloses the invention is a digital transfer organ employing standard small-scale and medium-scale integrated circuits obtainable in the current market and well known to all those familiar with digital design.

After conversion of the tone signals from digital to analog form, and their subsequent decoupling, multiresonant filter sets apply complexly reenforced and attenuated versions of the analog tone signals to amplifier-speaker systems which are so arranged as to duplicate the sounds of organ pipes distributed within a pipe enclosure.

The inventive organ employs further means: for sequencing signals from simultaneously or successively activated keys, for sequencing section-sets of tone units to which keys are coupled for the duration of their depression, for transfer of tone information from selected areas of voice memories to temporary memories in corresponding tone units in key-coupled sections, for effecting individualized durations of latent and active tonal attack and decay which are further made to vary with the rates of individual key depression and release, for generation of arrays of individually and optimally mistuned and phase-independent tone frequency currents from at least one high frequency source, for imparting sigmoid switching envelopes to tonal attack and decay, for generating pitch changes during keying, for generating and switching initial and terminal transient tones, for effecting normal tonal attack and decay with voice stop setting and resetting, and for employment of keyboard modules which are identical from one manual or pedal keyboard to another except for their automatically pre-programmable voice memories. Conventional means in the prior art, for electronic intercoupling of different keyboards or of different sections of given keyboards, are readily adapted to the inventive instrument.

Objects of the invention are:

to minimize the cost of realizing precise pipe organ sound electronically, by employing completely standardized circuitry for duplicating known properties of that sound;

to achieve such duplication by enabling key signals to initiate transfer of note information from permanent or quasipermanent electronic memories to temporary memories in a small number of identical tone units for each organ voice, in which the transferred information presets each unit so as to generate, switch, and decouple an individual note;

to transfer note information simultaneously from all memories to all tone units activated by given keys, thereby minimizing transfer time, and enabling stops which are set or reset after key depression to sound and terminate their corresponding notes in normal patterns of attack and decay;

to minimize tone keying and processing circuitry by sequencing and coupling activated keys to a small number of corresponding keying circuits and sets of tone units, which are thereby enabled to respond to subsequent signals from the activated keys until the keys are completely released;

to enable standard tone units for given voice stops to generate, switch and decouple main tones, initial transient tones, or terminal transient tones, by presetting plugs or switches for the units for given voice stops;

to effect individual, latent and active, tonal attack and decay characterized by transient changes in the amplitudes and frequencies of various harmonics, and appropriate time relations between keying phases of main and transient tones, by tone-unit-presetting signals from the temporary memories;

to effect keying phases and time relations which also vary with the rates of depression and release of individual keys, in duplication of expressive playing of individual notes as in tracker action pipe organs;

to derive arrays of permanently and optimally mistuned tone frequencies whose collective distributions around nominal note frequencies correspond to those of organ pipes in good tune, by dividing original or divided output frequencies of at least one high frequency source by cascaded, presettable dividing counters;

to realize by means of a digital sigmoid switch, individual sigmoid envelopes of tonal attack and decay duplicating the dynamic responses of organ pipes to key depression and release;

to effect various, precise degrees and patterns of individual decouplings of tone frequency currents so that their corresponding radiated sound duplicates that of organ pipes distributed in various spatial arrays;

to effect individual waveforms for all notes;

to effect mutual, random phase-independence of all notes;

to duplicate the complex patterns of tonal reenforcement and attenuation of organ pipe sounds, resulting from sound reflections and refractions within organ pipe chambers or cases, by radiating the acoustic counterparts of the outputs of sets of filters whose composite multiresonances correspond to those at cardinal points within such pipe enclosures;

and to provide for standardized architecture of a functionally individualized electronic organ in which each keyboard, its associated stops, tone units, couplers, and common sequencing and transfer means compose a standard module supplying tone signals to two voice decouplers, four multiresonant filter sets, four amplifier-speaker systems, and other elements common and sufficient to any desired multiplekeyboard organ as a whole.

DESCRIPTION OF THE DRAWINGS

In the drawings, lines corresponding to multiple channels contain encircled numerals showing the numbers of comprised channels. Except for elements first presented in FIGS. 10, 11, 13 and 14, the initial numeral of each part number corresponds to the number of the figure in which the part is first pesented. Encircled F-numeral symbols near various elements indicate the numbers of the figures which present the elements in greater detail or show their significant connections with other elements. In FIGS. 3–11, inclusive, and FIG. 14, part numbers accompanying the statements of input-sources and output-destinations of the figures' circuits indicate the corresponding general/particular elements.

FIG. 3 is a diagram of logic elements associated with an illustrative keyboard key, and a key sequencer serving an entire keyboard by identifying and transmitting in sequence, signals from simultaneously or successively activated keys.

FIG. 4 is a diagram of essential elements and interconnections of a standard, illustrative section coupler, or circuit for coupling initially depressed keys temporarily to tone units composing a section-set of such units, and an illustrative section sequencer serving an entire keyboard module by locating sections currently available for coupling to keys.

FIG. 5 is a block diagram showing essential elements of an illustrative transfer system serving an entire keyboard module by transferring note information from a selected address field of a voice memory (e.g., PROM) for each organ voice, to tone units in any coupled section, which sound particular notes for the unit's voice.

FIG. 6 is a diagram of an illustrative circuit for a tone unit's keying-phase control, and relations of the circuit to keys, voice stops, and the module's transfer system, and to logic arrays for controlling a phase-implementing counter P/N5 (presettable-divide-by-N counter, number 5) and for controlling a shift register-adder for developing different stages of sigmoid switching envelopes.

FIG. 7 is a diagram of a P/N3 counter for effecting presettable durations of keying phases, an illustrative, standard digital dynamic keyer creating different output signals for different rates of key movement, and a P/N4 counter for further modifying keying-phase durations according to given output signals from the dynamic keyer.

FIG. 8 is a diagram of an illustrative high frequency (HF) selector and two cascaded counters, P/N1 and P/N2, for generating optimally mistuned tone frequencies, ultimately from a single high frequency source.

FIG. 9 is a diagram of an illustrative, individually presettable, digital sigmoid switch, comprising a P/N5 counter for implementing individual keying-phase durations and the different stages of active keying-phases, a P/N6 counter variously presettable by the P/N5 counter and governing the magnitudes of waveform data-shifts which generate switching envelopes, a shift register for effecting such shifts, and a shift register-adder for rendering the resulting envelopes sigmoid in form.

FIG. 11 shows a block diagram of portions of an illustrative multi-resonant filter set of tone frequency filters having various transfer characteristics, for enabling a digital transfer organ to duplicate the complex effects of sound reflections and refractions within organ pipe enclosures.

DESCRIPTION OF A PREFERRED EMBODIMENT

The overall architecture of an illustrative electronic transfer organ is now described with reference to FIG. 13, in order to indicate the organ's organization into keyboard modules and into elements common to an entire instrument, the standard construction of all its homonymous elements and their interconnections, possible variations among and within manual keyboard modules and pedal keyboard modules, and the instrument's embodiment of all the necessary conditions of complete individuality of each separate tone in each separate voice, in data which can be automatically prestored in standard electronic memories for each voice.

Figure 13:
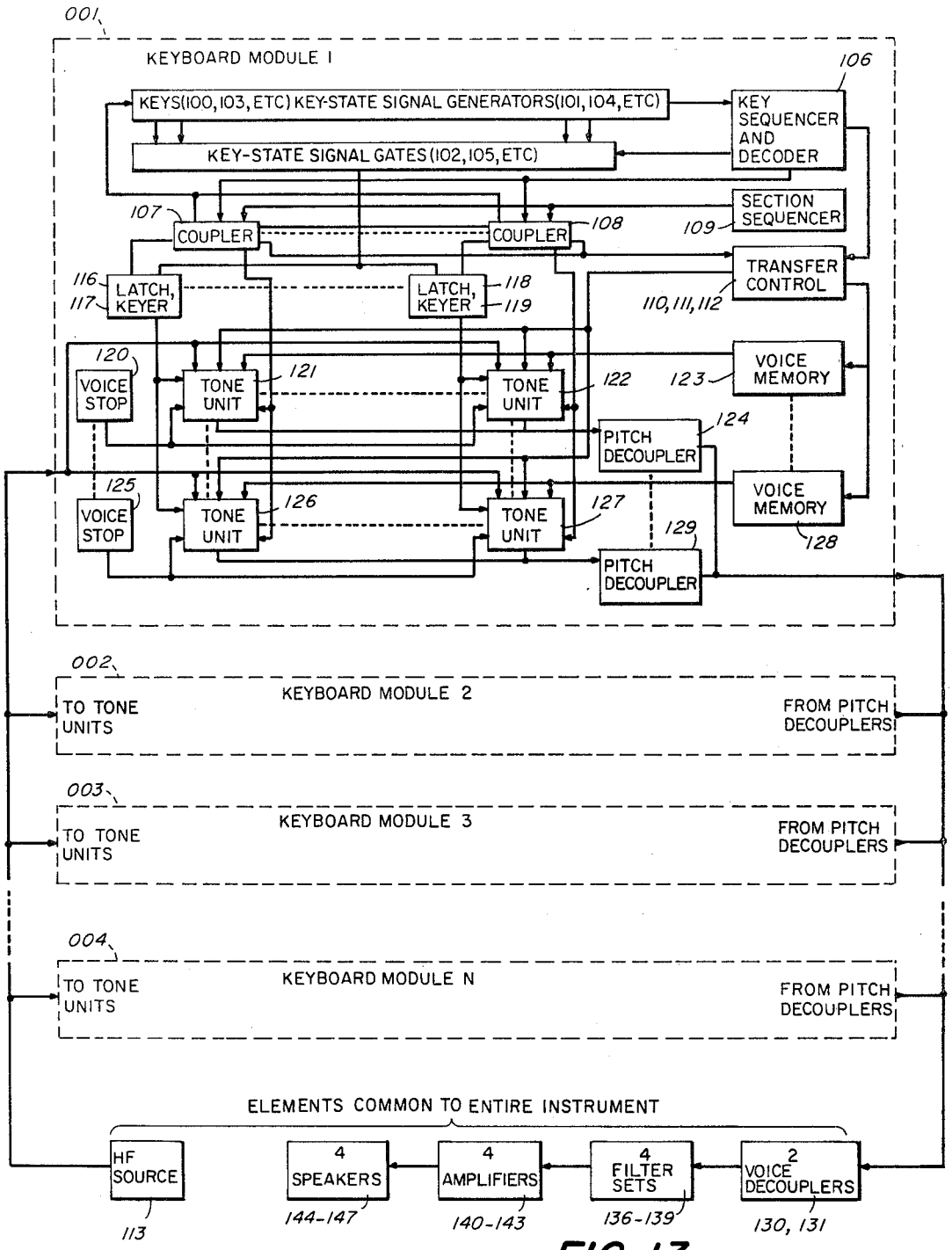
FIG. 13 shows a block diagram of an illustrative electronic transfer organ, including a simplified diagram of one illustrative keyboard module, block symbols for three other illustrative keyboard modules, the connection of a single high frequency (HF) source to all modules of the organ, and a simplified connection of all modules to two voice decouplers, four filter sets, four amplifiers, and four speakers, all of which arrays are common to an entire organ.

In FIG. 13, the four illustrative keyboard modules 001-004, inclusive, and the elements common to an entire electronic transfer organ, with which common elements all modules are connected, indicate characteristic and distinctive features of such an organ. Thus, while the figure shows four illustrative keyboard modules, an electronic transfer organ can comprehend any number of such modules, from one to the highest number which can be embodied in an overall structure still enabling players to manipulate them. Conventional interkeyboard coupling and stop combination setting means in the prior art, not shown in the figure, can extend the musical resources of a multiple-module instrument in the same way in which they augment such resources of pipe organs.

The module 1, shown in greater detail in the figure, includes a block symbol of an array of keyboard keys (100, 103, etc.). Any practical number of such keys can be encompassed by such a module. (Following standard contemporary pipe organ architecture, manual keyboard modules would normally comprehend 61 keys each, and pedal keyboard modules would normally comprehend 32 keys each.) The numbers of key-state-signal-generators and gates in a given module equal the number of keys in that module.

The figure shows two illustrative (section) couplers 107, 108 (each associated with two illustrative tone units shown below it). A manual module requires only as many couplers as there are keys which can be concurrently manipulated and which may be coupled to the module from a pedal module. Thus, both hands on a given manual keyboard can manipulate ten keys altogether, and both feet on a pedal keyboard can manipulate two keys altogether, making a total of twelve keys—and twelve corresponding couplers—in all. A manual keyboard module coupled only to another manual keyboard module is seen to require only ten couplers in each of the modules so coupled, since a player's two hands can manipulate only ten keys altogether on the same or two different modules. Therefore, twelve couplers suffice for any manual module intercoupled with a pedal module. A pedal module requires only two couplers.

The above statements follow from an assumption that only one person at a time is to play an instrument. If an instrument is to be played simultaneously by two performers, and its keyboard modules are intercoupled, its intercoupled modules will obviously require double the indicated numbers of section couplers.

One latch pair and one keyer are shown as also associated with each coupler, so that the total numbers of latch pairs and keyers in a given module correspond to the total number of couplers in that module.

The tone (generating) units associated with each coupler constitute a section-set of such units. The figure further shows one illustrative tone unit in each section-set as associated also with a single voice stop, a single voice memory, and a single pitch decoupler, each of the said single elements serving all the illustrative and other tone units in its voice. Such voice-associated tone units constitute a voice-set of tone units within the voice array of elements which includes also the said single elements. It follows that the number of units in a section set varies with the number of voice arrays. Also, as will be further indicated below, some organ voices comprise initial or terminal transient tones which are associated with the main tones which sound as long as corresponding keys are depressed. Such transient tones require their own tone units in addition to those required for the main tones. Furthermore, some organ voices, known as compound voices, or compound "stops", comprehend two or more different notes that sound concurrently when given single keys are depressed. The main and transient tone components of each of such pluralities of notes require their own respective voice sets of tone units. Thus, it is seen that the number of tone units in a section-set varies not only with the number of voices in a module, but also with the nature of those voices.

The figure further shows a single key sequencer/decoder a single section sequencer, and a single transfer control. These three elements altogether are necessary and sufficient to any module.

The number of counter-stages in key sequencers and section sequencers, and the number of storage locations in voice memories, can differ between a manual and a pedal keyboard module. The number of voice arrays can differ between modules of any type. The values of the binary words stored in a voice memory represent the different and distinctive identities of all notes in that voice. Therefore, the stored contents of voice memories typically differ from one voice to another and from one note to another.

Any of the following elements in any given module is structurally identical to the same nominal elements in the same or any other module: key-state-signal generators and gates, couplers, latches, keyers, voice stops, tone units, pitch decouplers, and transfer controls. Also, the connections between all elements in any module of a given type (i.e., manual or pedal) are identical to those of any other module of that type.

The above identities enormously simplify mass fabrication of modules and instruments, while possible, varied proliferation of modules, election of numbers of voices within given modules, and establishment of voice identities by selection of particular voice memories to be plugged into given modules, together simplify the assembly of either standard or custom instruments of any type or size.

An illustrative keyboard module will now be described in further detail, with reference to FIG. 1.

Figure 1:
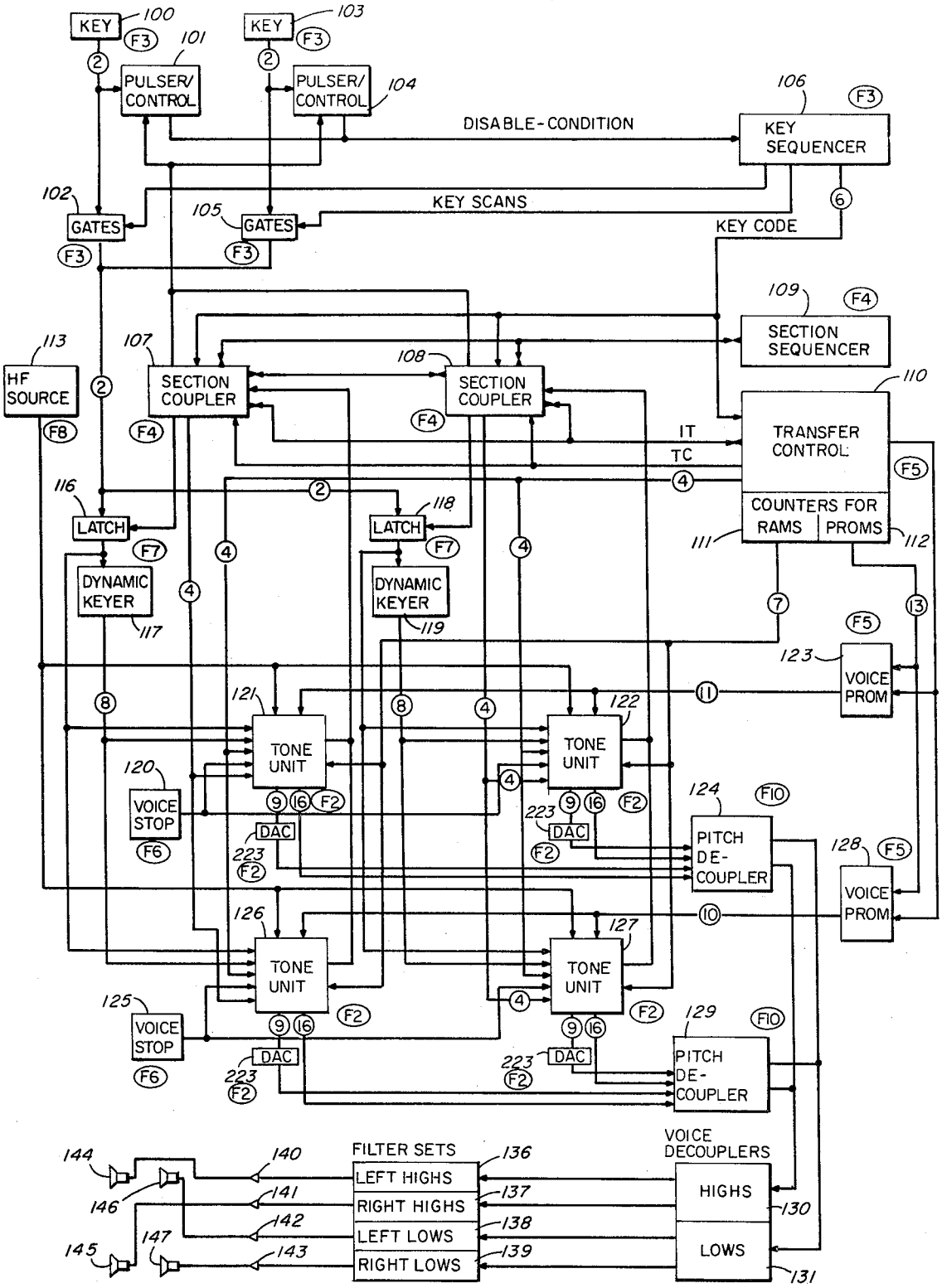
FIG. 1 is a block diagram of illustrative elements of a digital transfer organ keyboard module.
Figure 3:
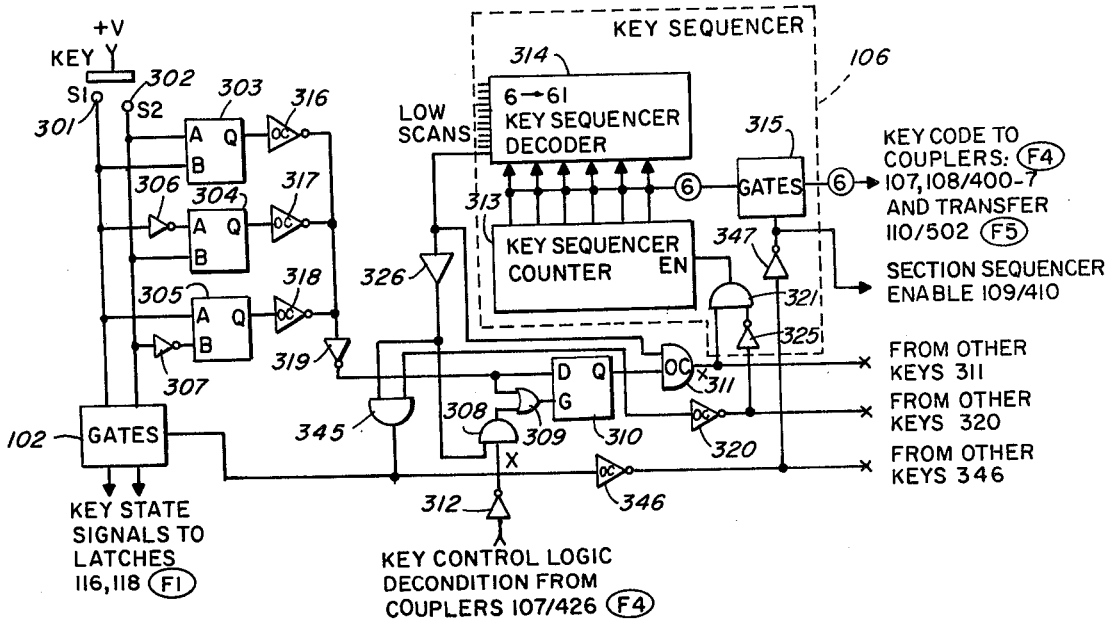

FIG. 1 shows two illustrative keyboard keys 100, 103, signals from which are applied to corresponding pulse-generating circuits and associated logic 101, 104 when the keys first manifest any of four states: partial depression, full depression, partial release, and full release. Since the pulse/control circuits and their functions are identical for all keys, the events initiated by key actions can be understood by reference to any key, e.g., 100, and to FIGS. 1 and 3. Thus, FIG. 3 shows that a constantly energized, depressed key first makes contact with a first flexible spring S1 (301), and then with a second flexible spring S2 (302). Conversely, when the key is released, it first breaks contact with spring 302, and then with spring 301. Flip flops 303, 304, 305 are one-shot multivibrators. Flip flop 303 momentarily sets when S1 becomes high (while S2 remains low), or when S2 becomes low (while S1 remains high). Flip flop 304 momentarily sets when S2 becomes high (while S1 remains high). Flip flop 305 momentarily sets when S1 becomes low (while S2 remains low). It is seen that each possible key-state-change applies a pulse which sets the latch 310. The setting of latch 310 conditions the key sequencer 106 for disablement.

Each flip-flop 303, 304, 305 is a retriggerable one-shot multivibrator, such as Type Number DM74123 manufactured by National Semiconductor Corporation, 2900 Semiconductor Drive, Santa Clara, California 95051. Each flip flop is triggered by a positive pulse-edge on input B (while A is low), or by a negative pulse-edge on input A (while B is high). Before the key 100 is depressed, both inputs A and B of each flip-flop 303, 304, 305 are low. Upon partial depression of key 100, input B of flip-flop 303 goes high via a positive pulse-edge. Since input A of flip flop 303 was low, flip flop 303 is triggered and its output Q goes high. The open-collector inverters 316, 317, 318 are so connected that if the output Q of any of the flip-flops 303, 304, 305 goes high, a low signal is transmitted to inverter 319 and thus a high signal is transmitted to the inputs D and G of latch 310, thereby setting it. It is seen that any key bounce during make or break, which produces a pulse or pulses too brief to trigger flip flop 303, 304 or 305, will quickly be followed by a pulse sufficiently long to effect such triggering and thus debounce any key action. Capture of the proper key state signals in latches 116 follows such triggering.

Latch 310 may be, for example, Type Number DM7475 manufactured by National Semiconductor Corporation. It accepts new data through input D when G is high, and holds those accepted data (rejecting further new data) when G is low. That is to say, when input G is high, output Q follows input D and goes high when D goes high, and goes low when D goes low. When G is low, the previous value of output Q is held. Before the key 100 is depressed, the latch 310 output Q is low because of deconditioning by the section coupler after processing a scan by the section sequencer. Whenever a high pulse signal is transmitted to both of the inputs D and G of latch 310 (such as upon any change in the key state), the latch 310 output Q goes and remains high.

Thus, upon partial depression of key 100, the output of flip-flop 303 goes high for the duration of the one-shot multivibrator's pulse width, and then returns to low. When this happens, both the D and G inputs to latch 310 first go high, setting the latch, and then return to low, leaving the latch set with its Q output high.

The circuit of the invention causes partial depression of a key to couple that key to an available section-set of tone units. One of the basic modular components of the invention is such a tone unit (shown in FIG. 2). Each tone unit contains a small memory which is adapted temporarily to store a group of words, each word being representative of instantaneous sound-wave amplitude, so that said group defines the wave shape of a note. Preferably each word is further representative in part of the corresponding note's rate of attack and decay, tone current frequency, changes in that frequency during attack and decay, and spatial location, so that the corresponding group further defines the said rates, frequency, frequency changes, and location.

As in a conventional pipe organ, in the electronic transfer organ of my invention various voice stops are provided, so that a given key may sound notes in one or more of a plurality of voices. For this reason the number of tone units must not only suffice for the maximum number of manual and pedal keys that can be depressed concurrently (e.g. ten fingers plus two feet, or twelve notes), but must also permit each key to sound notes from a mixture of some or all of the available voices. Therefore, the tone units are arranged in sections each of which has a tone unit for each available voice. Consequently, the first major event which happens upon partial depression of a key is the coupling of that key to an available section.

This coupling of a key to a section permits the storage of note-forming information in all the tone units of that section which correspond to that key, whether or not any corresponding voice has been activated by a voice stop. Such transfer conditions tone units for immediate functioning when their stops are set following key depressions. Coupling, which is initiated by partial depression of a key, also "reserves" the coupled section for that key, so that when that key manifests any of the remaining states (full depression, partial release, and full release), a suitable signal is transmitted to that section.

The first step in the initiation of coupling is the transmission of a digital word which identifies the key which has been partially depressed. Each key has its own pulser/control 101 which includes its own latch 310. The latch 310 corresponding to any partially depressed key is set so that its output Q is high, and therefore one input to the AND gate 311 for that key is high.

Each keyboard module in the electronic transfer organ of my invention includes a single key sequencer comprising a key sequencer-counter and a key sequencer-decoder. The key sequencer-counter, which may be clocked at 6.4 MHz, is adapted to count sequentially through a sequence of count values constituting codes identifying each of the keys. The key sequencer-decoder is adapted to scan the keys in succession in response to the sequence of count values. When the sequencer-counter reaches a count value corresponding to a key producing a key-state-change signal (i.e. a key whose latch 310 is set), it is temporarily disabled and the count value identifying that key is transmitted to other parts of the circuit. If the key-state-change signal is that of partial depression, then the count value is transmitted to means for causing transfer of words corresponding to the notes corresponding to that key into all the tone units of the coupled section. When transfer is complete, the latch 310 is unlatched, thereby deconditioning the key logic and preparing it to respond to a new state of the key. The key sequencer-counter is then enabled again only when state changes in other keys condition their logic to respond to ensuing scans.

Referring further to FIG. 3, the key sequencer 106 is seen to comprise a sequencer counter 313 whose 6-bit outputs compose a key-number code, or key code. These outputs are decoded by the decoder 314, for example, into 61 lines, or scans, corresponding to 61 keys on a standard manual keyboard. When a (low) scan from decoder 314 is not applied to AND gate 311 and flip flop 310 is set by a pulse from inverter 319, the resulting high outputs of AND gate 311 and inverter 325 cause AND gate 321 to enable the sequencer counter 313. When the sequence count, or low scan, arrives at the illustrative key 100 circuit, the resulting low output of AND gate 311 causes AND gate 321 to disable the sequencer counter 313. The high output of inverter 326 combines with the high Q output of flip flop 310 on gate 345 whose high output (doubly inverted by inverters 346 and 347) causes gates 315 to transmit the key code to the illustrative section couplers 107, 108 (and to the transfer control 110). The direct, high output of AND gate 345 further enables gates 102 to transmit the key-state-change signals to the inputs of all latches (116, 118) one of which will be enabled by its associated section coupler 107.

When a transfer of note information has been completed, the transfer control 110 transmits an enabling (TC, or "Transfer Complete") signal to couple a section coupler (e.g., 107) whose resulting low signal to inverter 312 drives its output high. This high output combines with that from inverter 326 to drive the output of AND gate 308 high, so that flip flop 310 resets, causing AND gate 345 to close key state gates 102 and key code gates 315, thereby leaving the key logic deconditioned until a pulse from its inverter 319 conditions it again.

Functioning of the inventive organ requires that a key which becomes partly depressed by coupled by a section coupler, to an available section-set of tone units so that note information can be transferred from selected fields of voice memories to the section-units' temporary memories, and so that the section so coupled will recognize the key and function appropriately when the key transmits its code again. The coupler must also latch the key-state-change signals and enable the section's dynamic keyer to respond to those signals. The coupler performs such various functions only when (1) a signalling key is not already coupled to another section, and the coupler's own section is not yet coupled to any key, or (2) when the coupler's section is already coupled to the signalling key.

The foregoing description of FIG. 3 has shown that partial depression of a key causes its latch 310 to be set, so that the scan of the key sequencer decoder 314 stops at that key, and the 6-bit output of the key sequencer counter 313, constituting the key code, is transmitted to all the couplers and to the single transfer-control 110. The setting of latch 310 also opens gates 102, so that the key state signals currently available from gates 102 are transmitted to all the latches 116, 118 while the latch 310 is set. Each section has one section coupler and one latch 116, 118.

Figure 5:
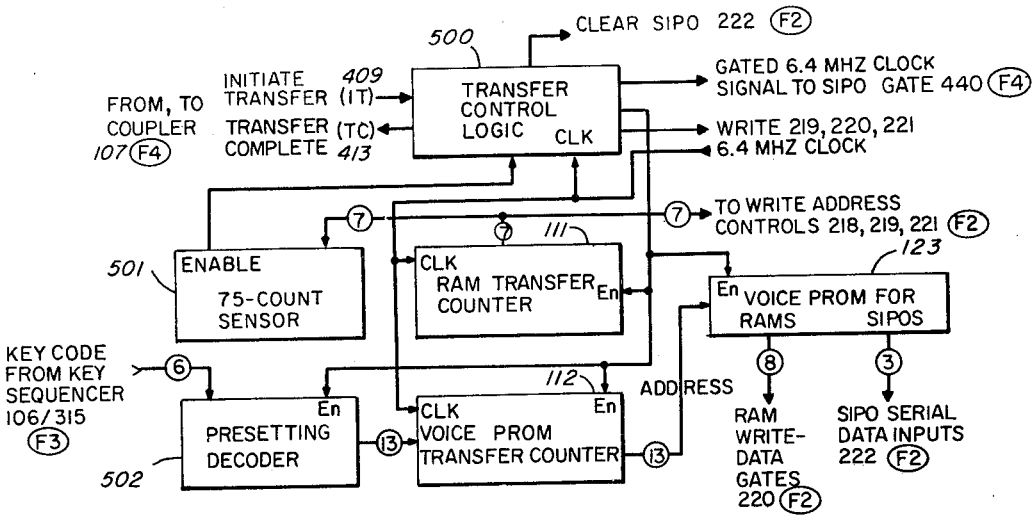

The tone-data transfer-causing means is shown in FIG. 5. Since the key sequencer 106 can send out only one key code at a time, the presetting decoder 502 of the transfer-causing means will have only one key code at its input.

Figure 4:
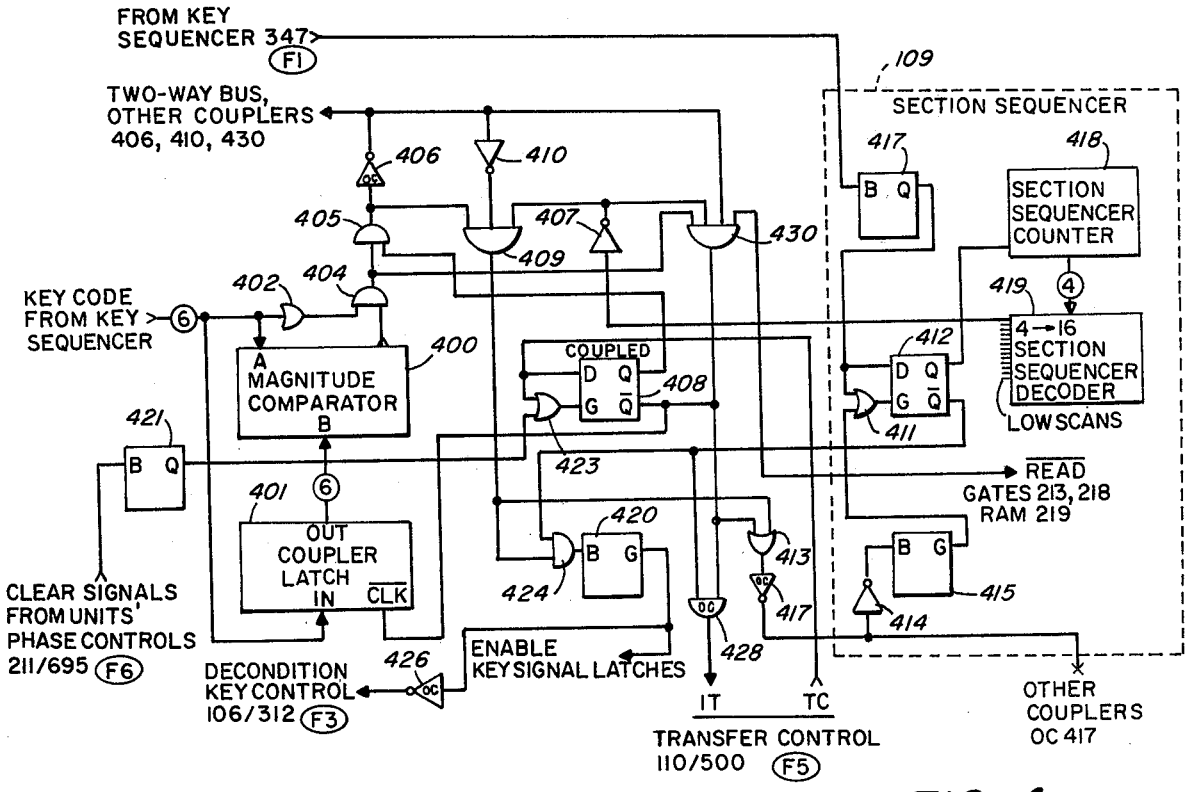

The transfer-control 110 is activated by an "initiate transfer" or (IT) signal which comes from one of the section couplers. However, as is shown in FIG. 4, the (IT) signal can only be sent out from one coupler at a time. This is because the open-collector AND gate 428 sends an (IT) signal from the coupler of a coupled section only when the scan of the section sequencer decoder has stopped at that section, and the scan must remain at that section until the "transfer complete" (TC) signal is received from the transfer-control 110. The coupler AND gate 428 is of the open-collector type because, of course, the AND gates 428 from all the section couplers are simultaneously connected to the (IT) input of the transfer control logic 500 (cf. FIG. 5).

FIG. 1 shows a matrix of four illustrative tone units 121, 122, 126, 127 in which units 121, 126 compose a first illustrative section-set, and units 122, 127 compose a second illustrative section-set. Further, units 121, 122 compose a first illustrative voice-set, and units 126, 127 compose a second illustrative voice-set. In an actual inventive organ, a manual keyboard which is not coupled to a pedal keyboard may need to comprise only 10 units in a single-voice set; if coupled to a pedal keyboard, a manual keyboard may need to comprise only 12 units per voice set. A pedal keyboard may require only two units per voice. Voices having initial or terminal transient tones associated with their main tones require two voice-sets of tone units. Compound voices require as many such sets or set-pairs as there are single voices in the compound voice.

From FIG. 1, it can be seen that a coupler (e.g., 107) is associated with a latch 116, dynamic keyer 117, and a particular section-set of tone units 121, 126. FIG. 4 shows essential elements and interconnections of a standard, illustrative coupler (e.g., 107) and of the single section sequencer 109 which sequences all sections in a module. The section sequencer decoder scans all sections as the output of the section sequencer counter proceeds. From FIG. 4, the section sequencer is seen to comprise a (4-stage) counter 418 and a 4-to-16-line decoder 419 of the counter's outputs. The counter 418 counts until its decoded scan arrives at an uncopuled section whose unit memories are therefore not loaded, whereupon the resultant setting of flip flop 412 disables the section sequencer counter 418 until the key sequencer enables the counter by triggering flip flop 417 which resets flip flop 412.

It was noted above that a coupler initiates transfer of tone forming information from large voice memories to tone units' small memories, reserves a section set of tone units for a depressed key, activates key state latches (e.g., 116), and enables the dynamic keyer counter (e.g., 117).

When the key sequencer 106 scans a key pulser 116 whose key action is "conditioned" (i.e., prepared to receive the scan), the key sequencer enables the section sequencer counter 418, causing it to scan the array of section couplers, and the key sequencer transmits the key code to the magnitude comparators 400 and latches 401 of all the module's section couplers. A particular coupler's response to receipt of a section sequencer scan depends on the identity of the key code which is transmitted to the coupler, and on the state and latched content of the coupler latch 401. The coupler latch 401 is a D-type, such as type SN54100 latch manufactured by Texas Instruments, Inc., Post Office Box 5012, Dallas, Tex. 75222. As long as the clock terminal of the coupler latch 401 is held high (as when the coupler's flip flop 408 is reset), the latch's output follows its input. When the clock terminal goes low (as when flip flop 408 is put into a set state), the coupler's output corresponds to the value of its input at the time the clock went low, representing a latched condition which persists as long as the clock terminal is held low.

When partial depression of a key applies the key's distinctive 6-bit code signal to coupler 107 which is not then in a coupled state, the coupler's flip flop 408 is in a reset state, and the output of the coupler's latch 401 follows its input. Since the same 6-bit signal is applied to the comparator 400's input A, the comparator's Y-output goes high and remains high as long as the indicated conditions prevail. The comparator 400 is a 6-bit type, such as type DM7160 manufactured by the National Semiconductor Corporation, 2900 Semiconductor Drive, Santa Clara, Calif. 95051.

If all six bits of an input signal are low, as when a key code is not applied, the output of 6-bit OR gate 402 remains low, so that the AND gate 404 output remains low. If, instead, there is applied a key code, one or more of whose six bits are high, the putputs of OR gate 402 output remains low. If instead, there is applied a key code, one or more of whose six bits are high, the outputs of OR gate 402 and the Y-terminal of the comparator 400 will both be high, so that the output of AND gate 404 is high, signifying a "local code match", or identical A and B code inputs to the comparator. Since the flip flop 408 is not in a set (coupled) state, the output of AND gate 405 remains low and the common output of OC (open collector) inverter 406 remains high. However, the high output of AND gate 404 is applied to AND gate 430. If no other coupler has already coupled the given key code, the common high outputs of the inverters 406 of all couplers are also applied to AND gate 430. Because, further, flip flop 408 is in a reset state, its high $\overline{Q}$ signal is also applied to AND gate 430.

When the low scan of the section sequencer decoder 419 then arrives at coupler 107, the resulting high output of inverter 407 is also applied to AND gate 430 whose output goes high. This high output signal, on OR gate 413, triggers one-shot flip flop 415, resetting flip flop 412 whose low Q output disables the section sequencer counter 418, thereby maintaining the section sequencer's scan on coupler 107. The high $\overline{Q}$ output of flip flop 412 also combines on AND gate 408, to transmit an "IT" (initiate transfer) signal to the module's transfer control 110.

When the ensuing transfer of tone forming information is complete, the transfer control 110 transmits a "TC" (transfer complete) signal to the coupler, which signal sets the coupler's flip flop 408, signifying a coupled state of the coupler 107. The resulting high Q output of flip flop 408 combines with the high output of AND gate 404 to drive the output of AND gate 405 high and the output of or inverter 406 low. The high output of AND gate 405 combines with the high output of inverters 407 and 410 to drive the output of AND gate 409 high. (The high output of AND gate 409, on OR date 413, again triggers one-shot flip flop 415, without material consequence in this instance, since flip flop 412 is already reset.) However, the high output of AND gate 409 combines with the high $\overline{Q}$ output of the reset flip flop 412 to trigger one-shot flip flop 420 whose output pulse causes the latches 116 to latch the key state signals applied to them by the key state gates 102, for example. The output pulse of flip flop 420 also deconditions the key logic by resetting its flip flop 310, whose resulting low Q output disables the key state gates 102 and key code gates 315. The latching of the high S1 and low S2 key state signals by latches 116 then initiates a count by the dynamic keyer counter 706, and prepares the phase control to generate a latent attack phase when the dynamic keyer count is complete.

Thus, the effect of partial depression of a key is to couple that key to an available section, to cause transfer of note forming information into the memories of the tone units in that section, to activate the dynamic keyer for measurement of the speed of key movement, and to prepare for generation of a latent attack phase when the speed has been measured at complete depression of the key.

Complete depression of a key causes a different response by a coupled coupler. When the key is completely depressed, its same key code is applied again to all the couplers' latches 401 and magnitude comparators 400. The output of the gates 404 of each coupler which has already coupled a different key code will remain low because such latched codes at the comparator's 400 input B differ from the code which is applied to its input A. The output of the gates 404 of all other couplers will be high because the codes applied to their comparators 400 A and B inputs will be the same.

However, because coupler 107 has already coupled the applied code, the output of its AND gate 405 will be high, holding the output of its OC inverter 406 low, so that the output of AND gate 430 cannot go high (to initiate a further transfer of tone forming information). Yet, again, the resulting high output of inverter 410 combines with the high outputs of AND gate 405 and inverter 407 to drive the output of AND gate 409 high, thereby disabling the section sequencer counter so as to capture the impressed scan, while then pulsing the key state latches 116 to latch the new key state signal for the dynamic keyer 117 and keying phase control 211 inputs, and to decondition the key pulser 101.

The events of the preceding paragraph recur when the key is partially released, and again when it is completely released. Thus, only partial depression causes tone information transfer, key state signal latching, and key pulser deconditioning; complete depression, and partial and complete release cause only key state signal latching and key pulser deconditioning.

When the outputs of all phase control OC buffers 695 finally go high (signifying termination of all the individual tones generated in the section), the coupler's one-shot flip flop 421 is thereby triggered, resetting the coupler's flip flop 408, that is, uncoupling the coupled key code and thereby preparing the coupler to couple a new key code when required.

When (1) a coupler 108 has already coupled a key code B, (2) the code is applied to all the couplers again, (3) another coupler, 107, has already coupled a different key code A, and (4) the section sequencer scan arrives at coupler 107, the absence of matched A and B inputs to coupler 107's comparator 400 will hold the outputs of its AND gates 404 and 405 low, so that neither of its AND gates 430 and 409 can have high outputs. Therefore, coupler 107 will not disable the section sequencer counter 418, and the scan will proceed to coupler 108 for its response.

When, instead, coupler 107 has not coupled any key code, including one already coupled by coupler 108, the matching inputs to coupler 107's comparator 400 will drive its Y-output and AND gate 404 high. However, the low output of coupler 108's OC inverter 406 prevents the output of coupler 107's AND gate 430 from going high, and coupler 107's low flip flop 408 Q output prevents the output of of its AND gate 405 and, therefore, of its AND gate 409, from going high. Again, coupler 107 will not disable the sequencer counter 418, and the scan will proceed to coupler 108 for its response.

As mentioned hereinabove, the initial significant effect of partial depression of a key, upon coupling an available section to that key, is the transfer of note information from large memories into the tone units of the coupled section. Preferably there is a large memory for each voice, and each section invludes a tone unit for each voice. Each tone unit includes a small memory to which the note information is transferred from a large memory. A preferred system for effecting transfer from large memories to small memories is shown in FIGS. 1 and 5. References should also be made to FIG. 2, which shows a representative small memory 219 in a tone unit.

Each large memory has a group of filled locations for each note in the voice corresponding to that memory. Each filled location contains a word representative of instantaneous soundwave amplitude, and each group defines a wave shape. Preferably, this word also is representative in part of the corresponding note's rate of attack and decay, tone current frequency, changes in frequency, and spatial location, so that the corresponding group in whole defines the said rates, frequency changes and location.

FIG. 1 shows a transfer system comprising a transfer control 110 and counters 111 and 112 for RAMs and PROMs, respectively. The RAMs are illustrative random-acess memories (or temporary, write-read memories) located in each tone unit. The PROMs, as illustrative voice memories, are programmable read-only memories. ROMs (read-only memories) or EPROMs (erasable, programmable read-only memories) can also serve as voice memories. Two illustrative voice PROMs, 123 and 128, are indicated in FIG. 1.

FIG. 5 shows the transfer system as comprising counter- and memory-enabling logic 500, a sensor 501 of counts-to-75 by the Ram transfer counter 111, and a decoder 502 for presetting the voice PROM transfer counter 112 so that it begins addressing a field of each voice PROM 123, 128 at the first of 75 binary words comprising the information for generating particular individual notes of the respective voices in the section's corresponding units.

As noted above, the disabled key sequencer applies the code for the currently scanned key to the transfer control 110, or, as FIG. 5 shows, to the presetting decoder 502. This is a 6-to-13-line decoder whose outputs comprehend 61 first-of-75 word addresses over a range of 4500 addresses in a 4575-word PROM. Each word in such a PROM (123, 128) comprises 11 bits, 8 of which comprise a 7-bit representation of a tone waveform amplitude and a sign bit at one point in a tone frequency cycle, of two to 75 such points, inclusive. The said 8-bits of each word are transferred in parallel to units' RAMs. The remaining three bits of each 11-bit PROM word are for presetting elements of a tone unit so that the unit can generate, switch, and decouple the tone whose waveform is established by the rhythmically swept RAM 219 (see FIG. 2). The series of three-bit groups are transferred serially to a three-division SIPO (serial-in, parallel-out) shift register 222 which subsequently applies them in parallel so as to preset the unit's tone-generating and -switching elements, and the unit's associated pitch decoupler.

When an IT (initiate transfer) signal arrives at the transfer control 110 from a coupler, the presetting decoder 502 and counters 111 and 112 are enabled. The decoder 502 presets the voice PROM transfer counter 112 to begin addressing the voice PROMs 123, 128 at the first of 75 words corresponding to the decoded key code while the outputs of the RAM transfer counter 111 scan the 75 8-bit word addresses in the section's unit RAMs 219, effecting the transfer of waveform data from the PROMs to the RAMs. Concurrently, the units' SIPOs 222, enabled for serial input, receive the series of three bits from the PROMs 123, 128. When the RAM transfer counter 111 reaches a count of 75, 75-count sensor 501 enables the transfer control logic 500 to disable both counters and to transmit a TC (transfer complete) signal to the involved coupler.

Referring again to FIG. 1, it is understood that the transfer control 110 enables the PROM transfer counter's (112) PROM-addressing presettings, and enables both illustrative PROMs 123, 128 for reading. This illustration signifies that note information is transferred simultaneously from all PROMs in a keyboard module to the RAMs 219 and SIPOs 222 in all units in a currently involved section-set. This simultaneous transfer not only minimizes the inventive organ's overall transfer time, but also conditions all the involved units to generate and switch notes sounded by a coupled key when stops are set after the key is already depressed.

The RAM transfer counter 111, PROM transfer counter 112, key sequencer counter 313, and section sequencer counter 418 may all be clocked at, for example 6.4 megahertz, so that each of these counters counts one step in 0.15625 microseconds. Thus, each transfer of 75 words requires 11.71875 microseconds, the 61 keys are scanned in 9.53125 microseconds, and the 12 sections are scanned in 1.875 microseconds. In an unlikely worst case in which the entire keyboard and all 12 sections require complete and separate scannings for each of 12 keys, all 12 transfers would be completed in 277.5 microseconds. Thus, sequencing and transfer processes in the digital transfer organ are too rapid to limit the speed of playing, or to affect the heard sound in any perceptible way.

There is one presetting decoder, and upon receipt of a key code it transmits the first address to the one voice PROM transfer counter 112, which then counts from that address through the ensuing 74 addresses corresponding to that note. In programming the PROMs, the 75 words representative of different notes sounded by a given key have the same addresses in each of the various voice PROMs, so that the output from the voice PROM transfer counter 112 can be applied simultaneously to all the voice PROMs 123, 128, etc.

While the illustrative dynamic keyers 117, 119 shown in FIG. 1 are not comprised by tone units, their functions are closely allied with those of certain unit elements, and are disclosed below in reference to FIGS. 2 and 7.

One of the major features of my invention is its use of a presettable standard tone unit whose structure, circuitry, and components are identical to those of every other said tone unit. Each standard tone unit comprises a small memory for the temporary storage and retrieval of tone-forming information. Typically each small memory includes a waveform RAM and a presetting SIPO register, associated with various counters and selector gates which are preset by the SIPO register. The said storage and retrieval are initiated ultimately by member-manipulation of keys and stops. The said tone-forming information presets and enables the unit to generate: (1) individualized tonal waveforms, (2) individually, permanently, and optimally mistuned tone frequency currents, (3) various sequences and individualized durations of latent or active tonal attack and decay of main or transient tones, which durations are characteristic of different pitches, tone qualities, and rates of key movement, (4) individualized, sigmoid keying envelopes of tonal attack and decay; (5) changes in tone current frequencies during attack and decay; and (6) to initiate and preset individualized decoupling of the said tone frequency currents from those generated by pluralities of other said tone units.

Figure 2:
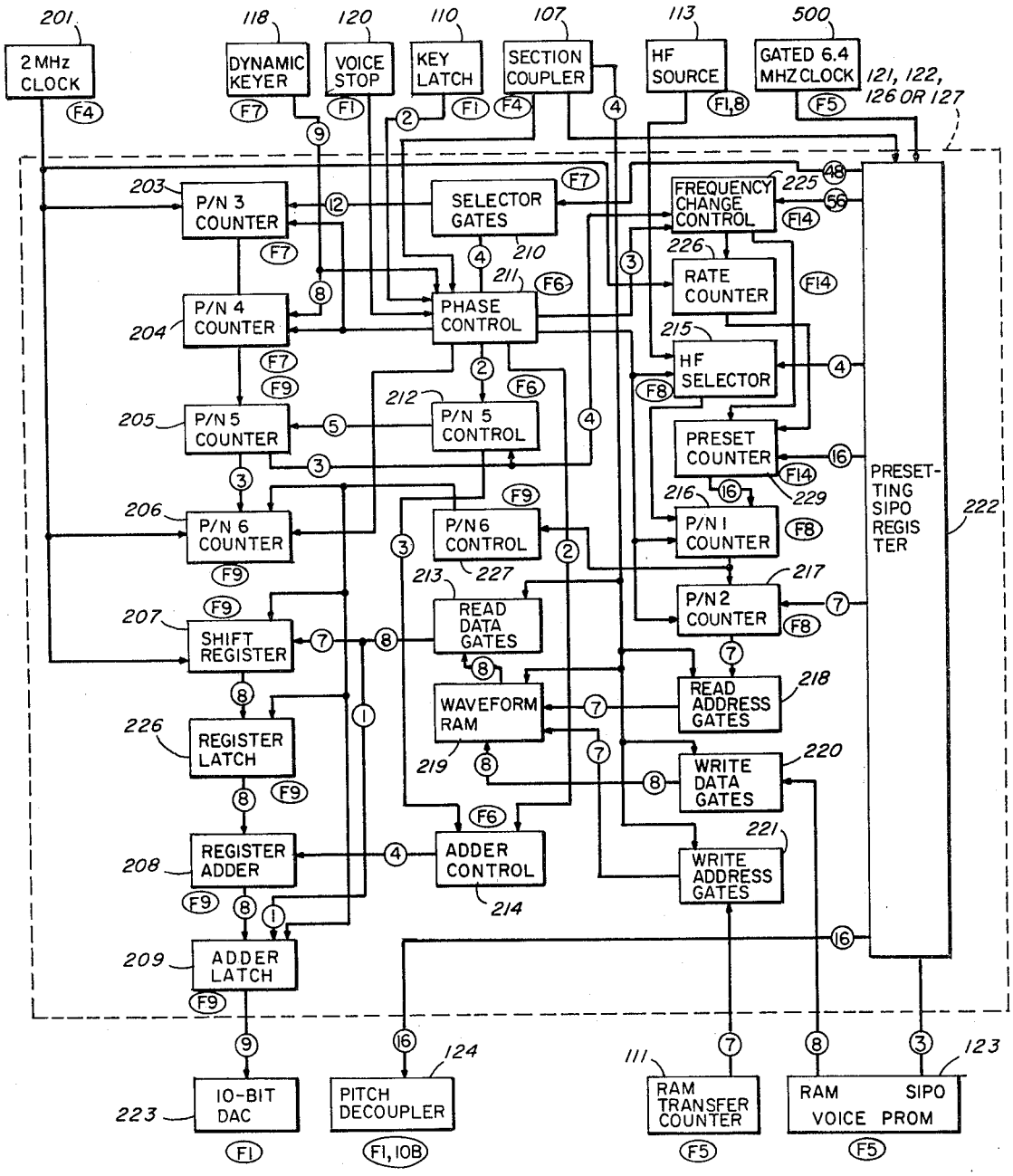
FIG. 2 is a block diagram of an illustrative standard tone unit of a digital transfer organ, and the other elements of the module and organ with which the unit is connected.

FIG. 2 introduces the elements of a standard tone unit, and their connections with each other and with elements outside the unit. The illustrative standard unit comprises all the elements enclosed by the broken line in FIG. 2. In the left portion of the unit is seen a series of elements, 203–208, inclusive, which collectively determine the sequence and durations of the four keying phases of a note (latent attack, active attack, latent decay, and active decay), the different stages in the implementations of active attack and decay, and the corresponding forms of their switching envelopes. The P/N3 counter 203 is preset by phase-duration codes transmitted from the SIPO 222 by selector gates 210 which are selectively enabled by the (keying-) phase control 211. Thus, before a tone actually begins to sound or to fade, the phase control 211 applies to P/N3 203 a presetting code which partly determines the duration of a latent attack or a latent decay interval. Organ pipes manifest such latent intervals between the times of key depression and the beginnings of their tones' onsets, and between the times of key release and the beginnings of their tones' decays. Also, initial or terminal transient tones which may be associated with main tones may have shorter or longer latent attack intervals than have their corresponding main tones. Codes for main tones and the two types of transient tones enable the inventive organ to duplicate such intervals and their interrelations. At the end of latent attack, the phase control 211 further enables the application of a code which partly determines the length of an active tonal attack. Prior to active tonal decay, a code partly determining the length of a latent decay phase is applied to the P/N3 counter 203. Finally, a code partly determining the length of an active decay is applied.

The more often the P/N3 counter is made to reset within a given time interval, the shorter will be the duration of the corresponding keying phase. Various presetting values characteristic of different pitches and different organ voices enable the inventive instrument to duplicate the keying behaviors of a wide variety of organ pipes. The 2 megahertz clock 201 and the twelve stages in the P/N3 counter 203, together enable the inventive organ to generate phase-durations characteristic of different kinds of organ pipes over an 11-octave range.

The Clear-pulse output frequency of the P/N3 counter 203 clocks the P/N4 counter 204. The P/N4 counter 204 is preset by the dynamic keyer 117 to divide this clock frequency by a value which varies inversely with the rate of key depression or release. Thus, slow key motion corresponds to a larger divider and to longer intervals between resettings of the P/N4 counter 204. Since the Clear-pulses of the P/N4 counter in turn clock the phase-stage P/N5 counter 205, the phase-durations are longer with the slower key movements and shorter with rapid key movements. Thus, the dynamic keyer 117 and the P/N4 counter 204 together lengthen or shorten the relative keying phase durations otherwise conditioned by the P/N3 counter 203. Such modifications of keying phase durations vary with the rate of key movement, as in a tracker action pipe organ.

When a new keying phase begins, the P/N5 counter 205 counts down from 7 to zero, and then up from zero to 7, at signals from the phase control's gate 608 or 609 (see FIG. 6) and thence from the P/N5 control 212. Since the P/N5 counter 205 is clocked by the resetting pulses from the P/N4 counter 204, the rate of the count-down-count-up sequence is determined by the divisor values preset in the P/N3 counter 203 and the P/N4 counter 204.

Thus, the P/N5 counter 205 determines the length of each phase by the time it takes for this counter to count down from 7 to zero and back up again to 7. During latent attack and latent decay it serves no other function. As shown in FIG. 2, when the key is fully depressed, the phase control 211 tells the P/N5 counter 205 to start its down-up count. This starts the latent attack phase. When the down-up count is complete, the P/N5 counter 205 tells the phase control 211 that the latent attack phase is complete. The phase control 211 then causes appropriate revision of various presettings to suitable values for the active attack phase, and then tells the P/N5 counter 205 once again to start its down-up count (this time at a same or different rate).

During active attack and active decay the P/N5 counter 205 not only determines the length of each phase, but also participates in formation of the sigmoid wave shape, and times any tone frequency changes during attack and decay. The first two of these three functions will now be described.

During active attack and active decay, gates 906 (see FIG. 9) apply the successive sets of the three Q-outputs of the P/N5 counter 205 so as to preset the 2 MHz-driven P/N6 counter 206 to count corresponding numbers of steps before resetting. Thus, as repeatedly and variously preset by the output of the P/N5 counter 205, the P/N6 counter 206 first counts to 7 and resets, then to 6 and resets, and so forth down to a zero count; then it counts to 1 and resets, then to 2 and resets, and so forth up to 7 and resets. The output of the P/N6 counter 206 causes the shift register 207 to make shifts of corresponding numbers of steps in length, in the direction of the least significant bit, thereby effecting successive divisions by 2. Thus, the number of such divisions corresponds to the lengths of the P/N6 counter's counts. The data shifted are waveform-point, 7-bit binary, amplitude words whose bits the read-data gates 213 transmit in parallel from the ryhthmically swept RAM 219 to the seven least significant stages of the shift register 207. Up to 75 such words are applied and shifted the same number of steps before the P/N5 counter 205 makes another count and thereby changes the lengths of the shifts.

Since each shift-step divides the applied tone-amplitude words by 2, the binary outputs of the shift register 207 are larger in value when the shifts have fewer steps. The P/N5 counter 205 counts both down and up in both active attack and active decay. Therefore, were it not for the shift register-adder 208, the corresponding tone would first emerge then disappear during tonal attack, and first disappear then reappear during tonal decay. At the end of the P/N5 counter's attack down-count, the shift register-adder 208 doubles the value of the half-way-on amplitude word, so generating a constant which it then adds to the complements of the ensuing, declining binary values from the shift register 207. The resulting sums generate the second half of a sigmoid attack envelope. In the first stage of tonal decay, the same constant is added to the complements of the progressively increasing binary values during the down-count of the P/N5 counter 205, and then during the second stage of tonal decay, the unmodified binary values themselves are transmitted during the up-count by the P/N5 counter 205, thereby generating altogether a sigmoid decay envelope. Such attack and decay envelopes duplicate those of keyed organ pipes, and obviously differ from the initially abrupt, logarithmic keying envelopes generated by most prior art electronic organs.

| Circuit element | Divisor | Output Hertz | Output Interval | Divisor | Output Hertz | Output Interval |
|---|---|---|---|---|---|---|
| Clock | — | 2 MHz | 0.5 us | — | 2 MHz | 0.5 us |
| P/N3 | 2 | 1 MHz | 1.0 us | 4096 | 488.3 | 2.048 ms |
| P/N4 | 2 | 500 K | 2.0 us | 2 | 244.1 | 4.096 ms |
| P/N5 | 14 | 35.7K | 28 us | 14 | 17.44 | .0573 s |
| P/N4 | 256 | 3.91K | 256 us | 256 | 1.907 | .5243 s |
| P/N5 | 14 | 279.0 | 3.58 ms | 14 | .1362 | 7.340 s |

As noted above, the P/N3 counter may be clocked at 2 megahertz. Counting in cascade, counters P/N3, P/N4 and P/N5 successively divide this clock frequency by divisors ranging between those shown in the table. Thus, the 12-stage P/N3 counter divides the 2 megahertz frequency by divisors ranging from 2 to 4096, thereby producing output frequencies ranging from 1 megahertz to 488.3 hertz. When the 8-stage P/N4 counter divides the maximum 1 megahertz output of P/N3 by divisors ranging from 2 to 256, the output frequencies of P/N4 range from 500 kilohertz to 3.91 kilohertz. Since the P/N5 counter always makes 14 counts (from 7 to 0, then back to 7), its division of these output frequencies of P/N4 by 14 yields output frequencies of 35.7 kilohertz to 279.0 hertz, which correspond to keying-phase durations ranging from 28 microseconds to 3.58 milliseconds.

When P/N4 divides the minimum 488.3 hertz output frequency of P/N3 by divisors ranging from 2 to 256, it produces output frequencies ranging from 244.1 hertz to 1.907 hertz. When these outputs of P/N4 are further divided by P/N5's constant divisor 14, the output frequencies of P/N5 range from 17.44 hertz to 0.1362 hertz, corresponding to keying-phase durations ranging from 0.0573 second to 7.340 seconds.

Thus, the circuit generates from the 2 megahertz clock frequency, keying-phases whose durations can vary from 28 microseconds to 7.340 seconds, a range defined by a factor of 262,144. The shorter keying-phase durations may correspond, for example to latent attack or decay intervals characteristic of the highest tone frequencies of an instrument, while the longer keying-phase durations may correspond to the protracted decay which is characteristic of organ voice notes simulating certain percussive instruments.

Figure 7:
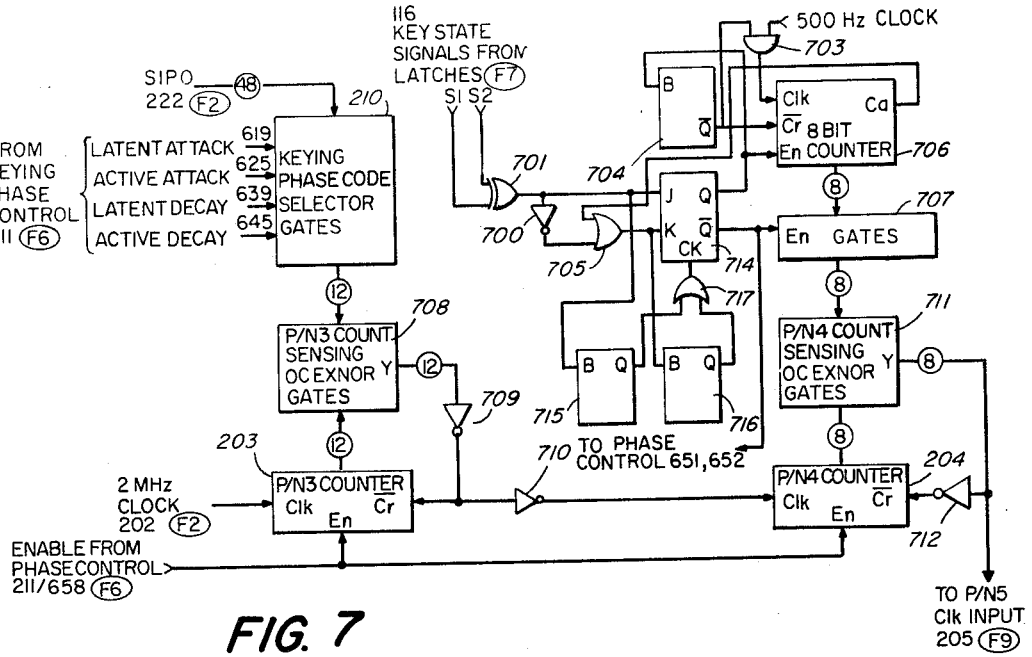

FIG. 7 shows the selector gates 210 and the P/N3 counter 203 associated with count-sensing OC EXNOR gates 708 (open collector, exclusive-NOR gates) which serve to reset the P/N3 counter 203 at the end of counts whose values are preset by the phase-duration codes. The Clear-count of the P/N4 counter 204 is similarly controlled by EXNOR gates 711, except that the count-extent is determined by the outputs of the dynamic-keyer counter 706. The inverter 700, the gates 701 and 702, the flip flop 714 and the associated flip flops 703, 704, 715, 716 function so as to initiate an attack up-count by counter 706 when the S1 signal becomes high, and to terminate and latch the up-count when the S2 signal also becomes high. The said elements also initiate a decay up-count by counter 706 when the S2 signal becomes low, and terminate and latch the up-count when the S1 signal also becomes low. The carry output signal from counter 706 terminates its up-count when key excursions over intervals greater than 0.246 second would otherwise reset the counter and initiate a new up-count. The maximum possible up-count also precludes excessively slow attack or decay. Thus, within this limit, the maximum up-count by the dynamic keyer counter 706 varies directly with the time interval between the two key-state-changes in either keying phase and, therefore, inversely with the speed of key movement in either phase. As noted, the corresponding frequency of the P/N4 counter 204 Clear-pulses then varies directly with the speed of the key movements.

The flip-flop 714 is a J-K master-slave flip flop, such as Type Number DM74107 manufactured by National Semiconductor Corporation.

It must be recalled that the interval between the time when the S1 signal becomes high and the time when the S2 signal becomes high is not the latent attack phase itself. The latent attack phase does not begin until after the S2 signal has become high and the dynamic-keyer counter 706 has completed its key-movement determined count. The dynamic-keyer counter 706 may be clocked at 1000 hertz, and its 8-bit output contemplates a maximum output of $2^8-1=255$. Therefore, the circuit shown can account for key-depression and key-release times up to 0.246 second.

As explained hereinabove, the P/N6 counter 206 counts at a rate determined by its clock input, which is furnished by a 2-megahertz clock 201. The P/N6 counter 206 performs its counting operation every time a load signal is delivered from the P/N1 counter 216. These load signals are delivered at a rate TP, where T is the required tone frequency and P is the number of points required to determine a given tone frequency waveform. Every time a load signal is delivered from the P/N1 counter 216 the following sequence occurs rapidly: the P/N6 counter 206 counts from a value determined by the preset input to the P/N6 counter 206, and the shift register 207 shifts the binary representation of the waveform amplitude then being presented to the shift register 207 from the RAM 219. The resultant output from the shift register is then used to deliver tonal amplitude signals at the rate TP. It is an important feature of my invention that the frequency TP is generated at one point within a presettable generator of permanently and optimally mistuned tone frequency currents which are further subject to controllable change during tonal attack or decay. Such a generator comprises means for selecting either a high frequency current originating in a given source, or an integral subdivision of that frequency, applying the selected frequency current as a clock frequency to the first of two presettable, tone-frequency generating counters, and applying the resulting output frequency current of the said first counter as a clock frequency to the second said counter. Such a generator also comprises means for temporarily presetting the first said counter to complete its recurring counts at a frequency equal to the arithmetical product of a desired tone frequency and the number of amplitude points on a tone waveform which suffice to establish its audible harmonic frequencies. Such a generator also comprises means for temporarily presetting the said second counter to complete its recurrent counts at the said desired tone frequency. Such a generator also comprises means for establishing various combinations of respective presetting values for the said two counters, so that a generated tone frequency differs by various small amounts from pluralities of other tone frequencies of the same nominal pitch and generated by other said tone frequency generators whose counters have other combinations of presetting values, so that all the tone frequencies generated for the said nominal pitch may differ from each other and the nominal frequency by various small amounts, so that the said tone frequencies fall within the range of mistune tolerance for the said nominal pitch, and so that the said frequencies distribute around the frequency of the said nominal pitch as do actual frequencies of optimally mistuned organ pipes. Such a generator also comprises means enabling the successive binary output values of the said second counter to address successively, repeatedly, and at an individually presettable rate, a series of binary words temporarily transferred to a waveform memory, each of the said words defining the amplitude of a corresponding point on the tone waveform.

The operation of such a generator will now be described in connection with a description of the operation of the P/N6 counter 206, since this counter is the first element in the circuit to be activated by the TP frequency.

FIG. 2 shows the counter P/N1 216 as generating carry pulses at the frequency TP referred to above. As also noted above, the outputs of counter P/N5 205 preset the counter P/N6 206 to count down to zero from the preset value. A TP pulse from counter P/N1 activates the P/N6 control 227 to enable the preset P/N6 count.

FIG. 2 further shows the same TP pulse applied as a clocking pulse to counter P/N2 217 whose given instantaneous outputs correspond to the address of a waveform-point word stored in the RAM 219. The corresponding binary data word is applied via the read data gates 213 to the shift register 207 which is clocked by the same 2 megahertz source which clocks the counter P/N6.

The TP-enabled signal from the P/N6 control, which enables the P/N6 count, also enables the shift register 207 to shift the data applied to it, toward the least significant bit. When the P/N6 count reaches zero, the P/N6 control disables the P/N6 count and terminates the shift register's shift sequence at values related to the presetting signals from P/N5. The corresponding output of the shift register 207 is held by the register latch 226 and transmitted to the sigmoid switching-envelope-generating register adder 208, until the next TP-enabled data shift is completed.

From the above, it is evident that each TP pulse simultaneously (1) generates a new address of a stored waveform-point word whose content is transmitted to the shift register, and (2) enables the shift register to decrement the binary magnitude of the transmitted word to a value representing the amplitude of the given point on the tone waveform at a given stage of the tone's attack or decay. A series of P TP-pulses therefore establishes the amplitudes of all requisite points on the waveform at the given step of tonal attack or decay. An ensuing step in tonal attack or decay is implemented by a new P/N6-presetting output from P/N5, whereupon further series of P TP-pulses establish new amplitude values for all the requisite points on the waveform. The changes in the P/N5 output are relatively slow, TP-pulses recur more rapidly, and the P/N6 count and shift register shifts are very rapid, usually enabling all points on a waveform to be established before the next change in P/N5 output occurs. Intrusion of a new P/N5 output before all waveform points are established during a given tone frequency cycle introduces brief, slight distortions in the waveform which are characteristic of waveform changes in the attack or decay of organ pipes.

| Shifts per sequence | Binary values of shift register outputs at the ends of shift sequences — Binary magnitudes applied to register inputs | | | | | | | |
|---|---|---|---|---|---|---|---|---|
| | 64 | 32 | 16 | 8 | 4 | 2 | 1 | 0 |
| 7 | 0 | 0 | 0 | 0 | 0 | 0 | 0 | 0 |
| 6 | 1 | 0 | 0 | 0 | 0 | 0 | 0 | 0 |
| 5 | 2 | 1 | 0 | 0 | 0 | 0 | 0 | 0 |
| 4 | 4 | 2 | 1 | 0 | 0 | 0 | 0 | 0 |
| 3 | 8 | 4 | 2 | 1 | 0 | 0 | 0 | 0 |
| 2 | 16 | 8 | 4 | 2 | 1 | 0 | 0 | 0 |
| 1 | 32 | 16 | 8 | 4 | 2 | 1 | 0 | 0 |
| 0 | 64 | 32 | 16 | 8 | 4 | 2 | 1 | 0 |

| | Values of shift register- and register adder-outputs during P/N5 down-up count | | | | | | | | |
|---|---|---|---|---|---|---|---|---|---|
| P: | P0 | P1 | P2 | P0 | P1 | P2 | P0 | P1 | P2 |
| Shift reg. input: | 64 | 32 | 0 | 64 | 32 | 0 | 64 | 32 | 0 |
| P/N5 preset of P/N6 | Shift register outputs | | | Register adder outputs during Tonal attack | | | Tonal decay | | |
| 7 | 0 | 0 | 0 | 0 | 0 | 0 | 128 | 64 | 0 |
| 6 | 1 | 0 | 0 | 1 | 0 | 0 | 127 | 64 | 0 |
| 5 | 2 | 1 | 0 | 2 | 1 | 0 | 126 | 63 | 0 |
| 4 | 4 | 2 | 0 | 4 | 2 | 0 | 124 | 62 | 0 |
| 3 | 8 | 4 | 0 | 8 | 4 | 0 | 120 | 60 | 0 |
| 2 | 16 | 8 | 0 | 16 | 8 | 0 | 112 | 56 | 0 |
| 1 | 32 | 16 | 0 | 32 | 16 | 0 | 96 | 48 | 0 |
| 0 | 64 | 32 | 0 | 64 | 32 | 0 | 64 | 32 | 0 |
| 1 | 32 | 16 | 0 | 96 | 48 | 0 | 32 | 16 | 0 |
| 2 | 16 | 8 | 0 | 112 | 56 | 0 | 16 | 8 | 0 |
| 3 | 8 | 4 | 0 | 120 | 60 | 0 | 8 | 4 | 0 |
| 4 | 4 | 2 | 0 | 124 | 62 | 0 | 4 | 2 | 0 |
| 5 | 2 | 1 | 0 | 126 | 63 | 0 | 2 | 1 | 0 |
| 6 | 1 | 0 | 0 | 127 | 64 | 0 | 1 | 0 | 0 |
| 7 | 0 | 0 | 0 | 128 | 64 | 0 | 0 | 0 | 0 |

As noted, shift sequences of various lengths diminish the binary values of the waveform words applied to the shift register inputs. The first table shows the binary values of shift register outputs at the ends of shift sequences of differing lengths (shifts per sequence) for various magnitudes of binary values applied to the shift register inputs.

The second table shows values of shift register-and register adder-outputs during a P/N5 (down-up) count cycle, for a simple, illustrative sawtooth waveform whose high frequency requires the establishment of only three points on the waveform during each tone cycle T. The illustrative shift register inputs for the three waveform points P0, P1, P2 have the illustrative values 64, 32, 0. As P/N5 counts down, the shift register outputs corresponding to shift register inputs greater than zero are seen to increase, first slowly, then rapidly. As P/N5 counts up, these outputs decrease, first rapidly, then slowly. These rates of change represent the shift register-output differences resulting from the shift register's division of its inputs by various powers of 2.

The sigmoid-envelope-generating function of the register adder 208 was described above and will be further explained below. The second table shows register adder 208 outputs for the illustrative sawtooth waveform during a P/N5 cycle, for tonal attack and tonal decay, respectively.

Thus, in tonal attack, the register adder outputs for shift register inputs greater than zero are seen to increase, first slowly, then rapidly, then slowly again. During P/N5's tonal attack down-count to zero, the register adder's outputs equal its inputs. During P/N5's tonal attack up-count, the register adder's output equal the difference between its given instantaneous inputs, and twice the value of its output when the P/N5 tonal attack down-count had reached zero. As noted, the result is a sigmoid envelope of tonal attack.

In tonal decay, the register adder outputs for shift register input greater than zero are seen to decrease, first slowly, then rapidly, then slowly again. During P/N5's tonal decay down-count to zero, the register adder's outputs equal the differences referred to in the preceding paragraph. During P/N5's tonal decay up-count, the register adder's outputs again equal its inputs. The result is a sigmoid envelope of tonal decay.

The slight variations in waveform, at the extremes of tonal attack or decay, corresponding to the constancy of the illustrative values at P1, remain undetectable by a listener.

Figure 8:
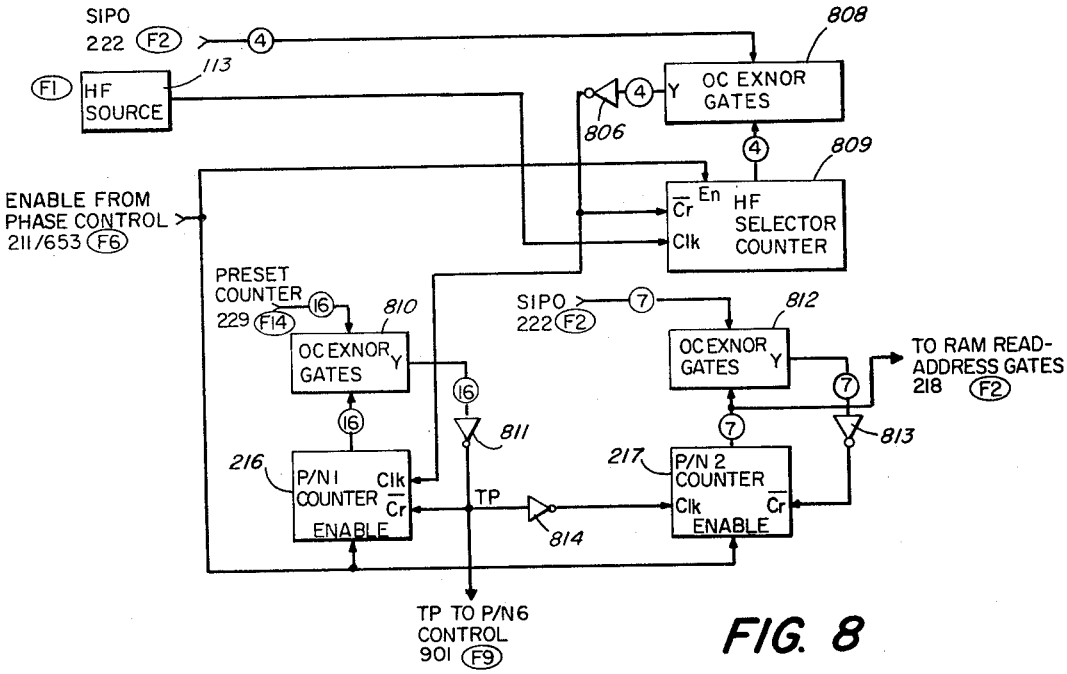
Figure 9:
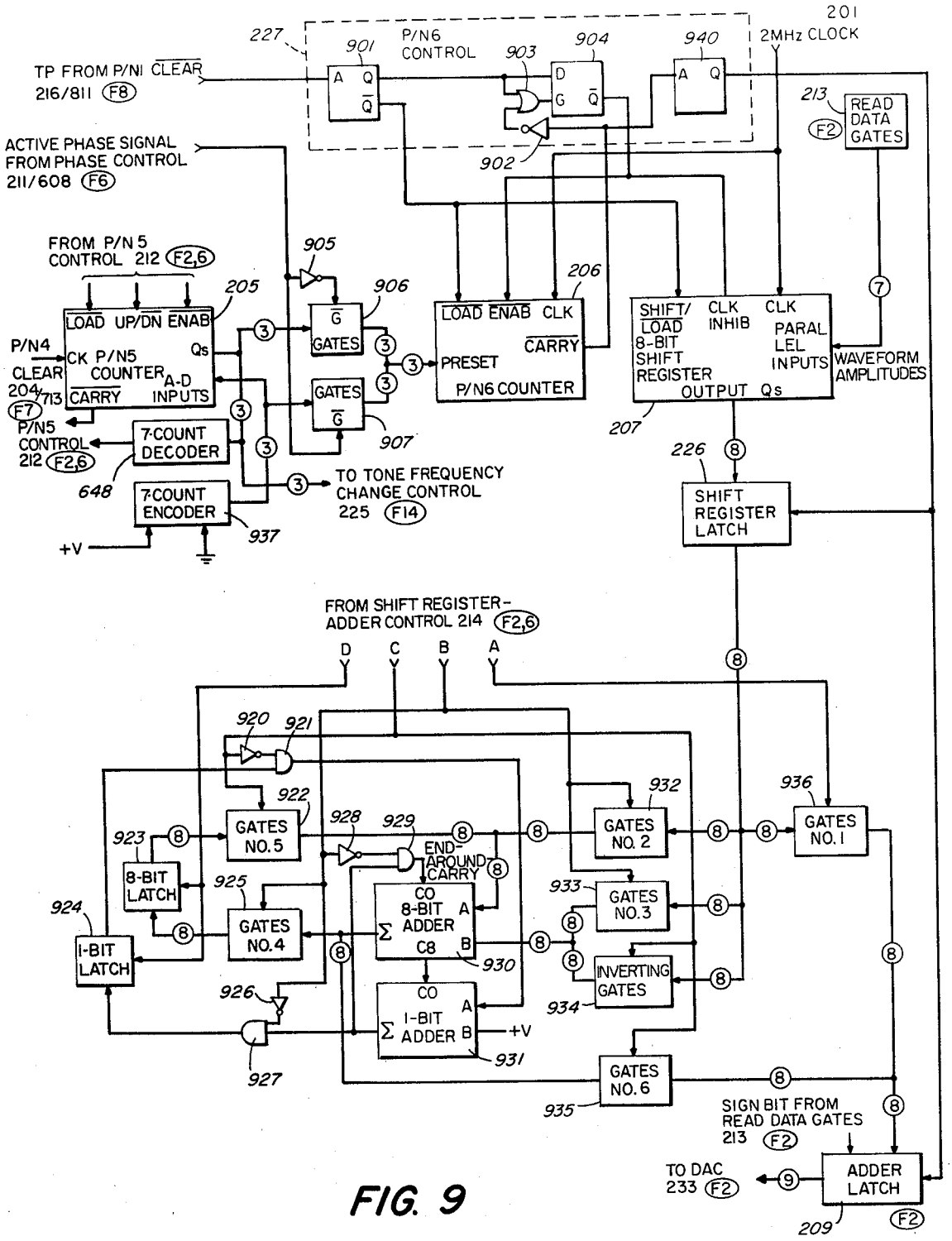

The more detailed functioning of the P/N6 counter 206 in FIG. 9 rests partly on that of two tone frequency generating elements: the HF selector 215 and P/N1 counter 216, shown just above the right center of the tone unit in FIG. 2, and in more detail in FIG. 8. FIG. 2 implies that the presettable HF (high frequency) selector 215, driven by the single HF source 113 (e.g., 20 MHz), drives the P/N1 counter 216. FIG. 8 shows EXNOR gates 808 which preset the HF selector counter 809 to divide the high frequency from the HF source 113 by a divisor greater than unity, to generate a clock frequency for P/N1. Such lower source frequencies make it possible to generate lower tone frequencies with the relatively limited numbers of stages in counters P/N1 216 and P/N2 217. A source frequency, from one of the indicated selections, clocks the P/N1 counter 216, whose corresponding output frequency TP is a product of P, the number of points required to determine a given tone frequency waveform, and T, the required tone frequency. (Since higher harmonics of high tone frequencies are inaudible, fewer points are required to determine their waveforms, so that TP rarely if ever needs to exceed 60 KHz.)

FIG. 8 shows that the Clear-pulse, or TP, frequency output of the P/N1 counter 216 is applied to the P/N6 counter 206 control, and FIG. 9 shows flip flop 901 of that control receiving the TP frequency. When an active keying phase (active attack or active decay) signal is being received from the phase control 211 and enables gates 906, a TP pulse from the P/N1 counter 216 enables flip flop 901 to load the presetting binary output of the P/N5 counter 205 into the P/N6 counter 206, and the immediate, seven, parallel, waveform bits from the RAM 219 into the shift register 207 which may be clocked at 2 MHz. The P/N6 counter 206 and shift register 207 are then enabled by flip-flop 904, and the results of their respective count and shift are maintained by the shift register latch 226 until the next TP pulse arrives at gate 901 to initiate a next count-and-shift sequence and that sequence has been completed. After a number of such sequences, each of which sequences establishes momentary amplitudes for all required points on a tone waveform, new presetting signals are transmitted from the P/N5 counter 205 to P/N6 counter 206, and a new series of count-and-shift sequences is initiated and completed. Such operations enable the changes in tonal amplitudes which correspond to tonal attack and decay.

When no active-phase signal is received from the phase control 211, gates 907 apply a constant binary-7 to the P/N6 counter 206, thereby presetting P/N6 to hold a tone fully on between the end of active attack and the beginning of active decay. Since no waveform data are applied to the shift register before active attack begins and after active decay ends, the said binary-7 output of gates 907 does not produce tones under these two conditions.

The lower portion of FIG. 9 shows the register-adder 208 as comprising elements 920–936, inclusive. The functioning of the adder 208 is first described with reference to tonal attack. During the first stage of tonal attack, the P/N5 counter 205 counts down, causing the shift register 207 to shift its impressed binary words in the direction of the least significant bit in successively smaller amounts with each shift sequence, thereby establishing successively larger binary values in the shift register's output. Since each shift step divides the binary values by 2, and since the number of shift steps declines with the P/N5 down-count, the increase in the binary value of the shifted words is increasingly rapid as the attack down-count proceeds, thus effecting a positively accelerated increase in the value of the binary output. During this first stage of tonal attack, the shift register adder-counter 214 enables only gates 936, thereby applying the increasing-valued binary words themselves to the adder latch 209. When the down-count of the P/N5 counter 205 reaches zero, the adder-control 214 also enables the B-group gates 925, 927, 929, 932, 933 and the D-group latches 923, 924, causing the register-adder 208 to double the magnitude of the maximum binary word and hold the result as a constant in latch 923. When this has been done, the adder-control 214 disables the A- and B-group gates and gates 936, and enables the C-group gates 921, 922, 934, 935. These further actions cause the adder 208 to add the constant which is stored in latch 923 to the complement of each suceeding binary word from the shift register 207 during P/N5's ensuing up-count, and to transmit the sums to the adder latch 209. Since the values of the shift register output words decline at a progressively slower rate during P/N5's up-count, the sums (constantly augmented complements) increase at a progressively slower rate, thus generating a negatively accelerated rising function during the second, or up-count, stage of the attack phase. The overall result of both stages is a sigmoid attack pattern.

During the first stage of tonal decay, in which P/N5 again counts down, the adder control 214 continues to enable the C-group gates, thus causing the binary output values of the adder 208 to decline with increasing rapidity at the inputs of the adder latch 209, so as to generate a positively accelerated declining function. When P/N5's down count ends, the adder control 214 disables the C-group and D-group gates, and enables the A-group gates 936 again to apply the direct binary outputs of the shift register 207 to the adder latch 209 during the second stage of tonal decay. Since these latter binary output values decline at a decreasing rate during the up-count stage, the overall result is a sigmoid decay pattern.

In view of the functioning of counters 203, 204, 205, it is evident that the overall rate of tonal attack or decay varies with different presettings of the counters 203 and 204. However, considering also the functioning of P/N6 counter 206, the shift register 207, and the register-adder 208, it is evident that, while the overall steepness of attack or decay envelopes varies from one note or keying to another, the configuration of each envelope remains sigmoid.

In the above reference to the operation of the P/N5 counter 205, the generation of a frequency TP by the P/N1 counter 216 was described. When this TP frequency which is the Clear-impulse output of P/N1 is applied as a clocking pulse to the P/N2 counter 217, and P/N2 is preset by SIPO 222 signals to divide the TP frequency by P (the number of points on a particular waveform whose amplitudes require establishment), the frequency of P/N2's Clear-pulses equals T, a tone frequency at which the 8 Q-outputs of P/N2 rhythmically sweep the RAM's corresponding waveform-point-amplitude addresses. Seven bits of each read 8-bit word, representing a waveform-point-amplitude, are thereby applied in parallel to the shift register 207, as indicated above. The eighth, or most significant, bit is applied as a sign bit to the tenth-bit input of a 10-bit DAC whose function is described below.

Figure 12:
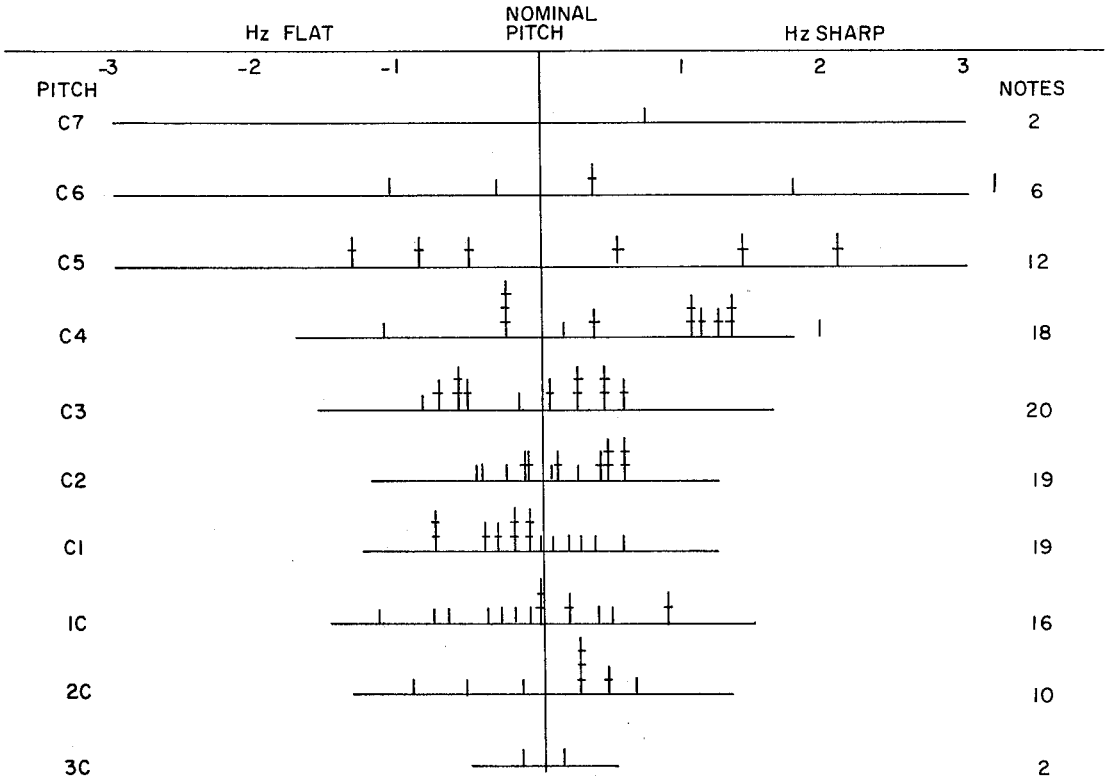
FIG. 12 shows distributions of optimally mistuned organ pipe tone frequencies of 121 C-notes at ten different octave levels, with the distributions and corresponding mistune-tolerance ranges (represented by the horizontal lines of various lengths) centered on their respective, nominal tone frequencies for ease of comparison.

While it is well known that a counter's discrete divisions of an impressed frequency yield finite series of frequency-quotients differing regularly by relatively large amounts, the present invention takes the further step of employing various selected combinations of presettings of two such counters (P/N1 and P/N2) in cascade, to generate arrays of tone frequencies differing from each other and from their nominal tone frequencies by various small and irregular amounts, and distributed around the nominal frequencies of pitches so as collectively to approximate normal probability distributions, as optimally mistuned organ pipe frequencies are shown in FIG. 12 to be distributed. Such distributions for each note are confined within the limits of the note's distinctive mistune-tolerance. Thus, FIG. 12 shows C-notes in three top octaves as tolerating mistune over a 6 Hz range, whereas optimally mistuned notes in the lowest octave are confined to a range of about 1 Hz. Any mistune within the limits of such mistune-tolerances is optimal, since the mistune generates chorus and other effects which are pronounced enough to be musical but not so pronounced as to be dissonant.

It is evident that the inventive organ's generation of all individual tone frequencies from at least one HF source, by different predetermined combinations of cascaded-divider presettings, maintains the instrument in permanent, optimal mistune. A digital transfer organ requires no returning at any time.

It might be inferred that such generation of tone currents of different frequencies, ultimately from a given HF source, precludes random phase-independence among the inventive organ's various notes. However, even for any two or more notes generated by tone units within a given section-set and therefore keyed by the same dynamic keyer, the various presettings of their respective P/N3 and P/N4 counters create differences between their P/N4 counts, which differences vary with different rates of key movement. Since small variations in such rates are not subject to voluntary control and therefore tend to be random, the corresponding small differences between two concurrent P/N4 count rates also vary randomly. Thus, on different occasions of keying, two or more notes concurrently keyed by the same dynamic keyer begin their tonal attacks at variously different times within their respective cycles. Since the variation of such time-differences is random, the notes manifest random, mutual phase-independence. Random phase-independence is intrinsic to a digital transfer organ.

FIG. 2 shows a preset counter 229 receiving from the SIPO 222 a 16-bit signal which the preset counter applies unchanged to counter P/N1-presetting-EXNOR gates 810 when a tone frequency remains unchanged during tonal attack or decay.

When a tone frequency changes during tonal attack or decay, the frequency change control 225 sets the preset counter 229 to count either up or down, and sets the rate counter 226 to pulse the preset counter 229's clock input at a selectable rate over a selectable time interval. The resulting count by the preset counter 229 alters the count rate of counter P/N1 216 and therefore the frequency of its TP output. Since the TP frequency output of counter P/N1 216 clocks counter P/N2 217 whose rhythmic clear pulses constitute a tone frequency, the said change in the TP frequency produces a proportional change in the tone frequency.

Figure 14:
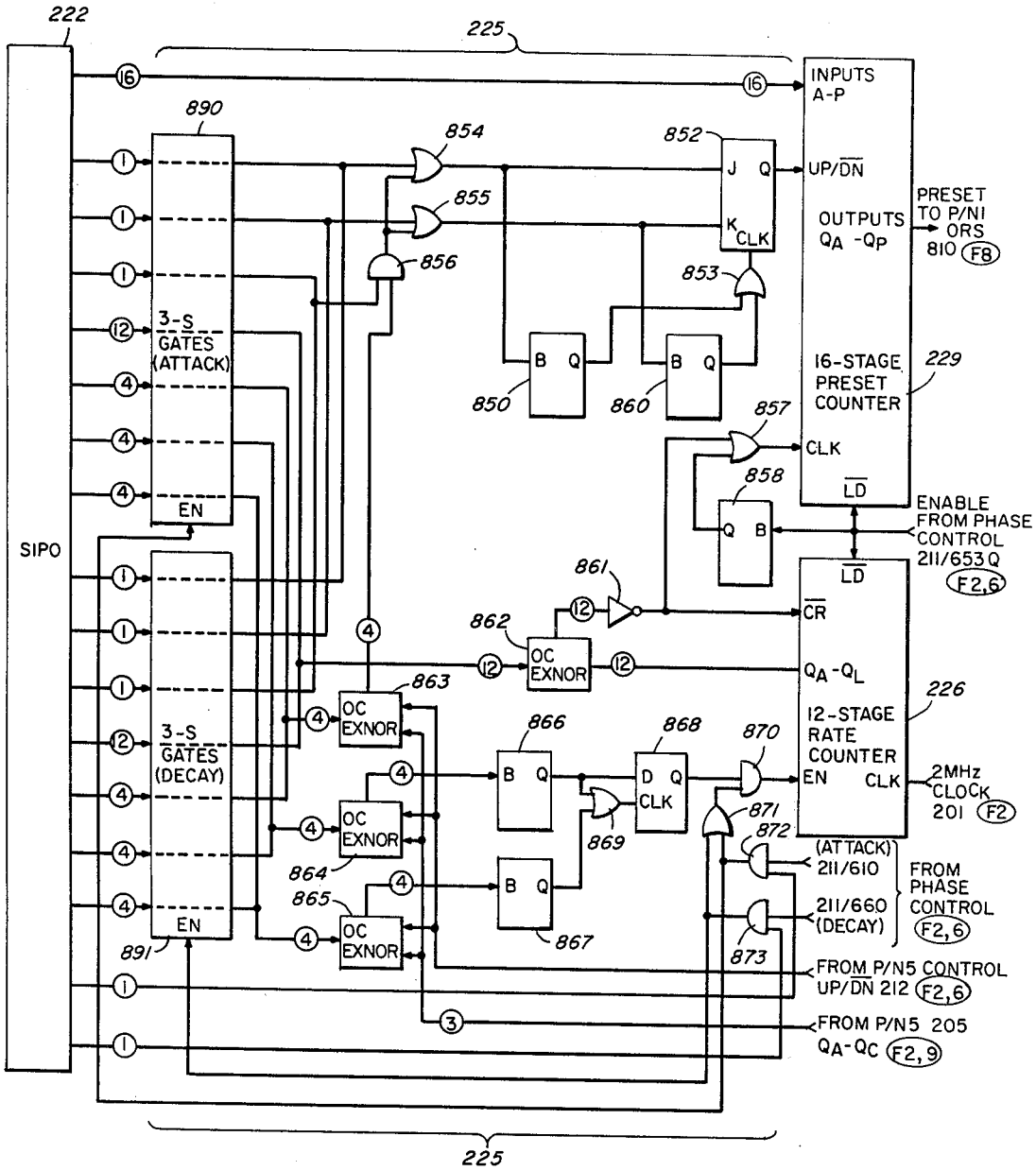
FIG. 14 shows an illustrative circuit for changing tone current frequencies during tonal attack and decay.

FIG. 14 shows an illustrative tone frequency change circuit including a rate counter 226, a preset counter 229, and elements of a frequency change control 225. The preset counter 229 is shown receiving the 16-bit signal from the SIPO 222, which signal is loaded into the preset counter 229 when a signal from the phase control's tone-count-enabling flip flop 653 triggers the frequency control's flip flop 858, causing it to apply a single pulse to counter 229's clock input. This single clocking pulse causes the 16-bit signal to appear at the Q-outputs of counter 229 and at the P/N1 EXNOR gates 810. As long as counter 229 receives no further clock pulses during tonal attack or decay (from the clear pulse of the rate counter 226), the correspondingly preset TP count-rate of counter P/N1 and its corresponding tone frequency output of counter P/N2 remain constant.

If a tone frequency changes during tonal attack, a 1-bit SIPO signal to AND gate 872 combines with an active-attack signal from the phase control inverter 610 to enable the tri-state gates 890 for implementing tone frequency change during tonal attack, and to contribute to the enabling of the rate counter 226. If a tone frequency changes during tonal decay, a different 1-bit SIPO signal combines with an active-decay signal from the phase control's inverter 660 to enable the tri-state gates 891 for implementing tone frequency change during tonal decay, and to contribute to the enabling of rate counter 226.

Thus, enabling of the tri-state gates 890 presets the frequency change control 225 to implement tone frequency change during tonal attack, and enabling of the tri-state gates 891 presets the frequency change control 225 to implement tone frequency change during tonal decay. During the transfer of tone-forming information from voice PROMs, the SIPO 222 can be loaded to preset the control 225 to implement distinctive tone frequency changes during tonal attack, decay, or both. The actual initiation of a tone frequency change during tonal attack is then enabled by an active-attack signal from inverter 610 of the phase control, and the actual initiation of a tone frequency change during tonal decay is enabled by an active-decay signal from the phase control's inverter 660.

Since any clear-pulse from the rate counter 226 clocks the preset counter 229, each said clock pulse increments or decrements the initial P/N1-presetting output of the preset counter 229 by one, causing the TP and tone frequencies to change accordingly. Thus, the said signals from the SIPO and phase control determine (1) whether a tone frequency change occurs during tonal attack, decay, or both, and (2) that the appropriate changes occur during the respective keying phases.

The changes in tone frequency characteristic of tonal attack or decay of certain organ pipes can begin and end at various times within such keying phases. (Changes in tone frequencies during tonal sustain can be duplicated by various means within the prior art.) In my invention, the beginning and ending of tone frequency changes during tonal attack or decay are established by congruences of presetting signals from the SIPO 222, and the counter P/N5 205 and its control, at EXNOR gates 864 and 865.

The up/$\overline{\text{down}}$ signals from the P/N5 control 212, and the 3-bit signals from P/N5's $Q_A$-$Q_C$ outputs, inclusive, together constitute a 4-bit binary code which assumes 15 different values during the course of each P/N5 down-up count cycle.

FIG. 14 shows such 4-bit P/N5 count-cycle code signals as applied to EXNOR gates 864. When a said code signal corresponds to the 4-bit signal from the SIPO, flip flop 866 is triggered so as to set flip flop 868, enable the rate counter when enabling signals from the SIPO 222 and phase control 211 are also present, and thereby initiate a tone frequency change at the SIPO-programmed point during tonal attack or decay.

FIG. 14 further shows the P/N5 count-cycle code signals as applied also to EXNOR gates 865 which receive a distinctive 4-bit signal from the SIPO. When these two sets of signals on the EXNOR gates 865 correspond, flip flop 867 is triggered so as to reset flip flop 868, disable the rate counter 226, and terminate the tone frequency change at the SIPO-programmed point during tonal attack or decay.

By such means, P/N5 count-cycle code signals initiate and terminate otherwise enabled tone frequency change at any selectable pair of times out of 15 different times during tonal attack or decay.

Whether a tone frequency is to increment or decrement during either tonal attack or decay depends on whether the preset counter 229 counts up or down. If it counts up, P/N1 is thereby made to divide a selected high frequency (from HF selector 215) by progressively larger divisors, and therefore to count at a decreasing TP frequency, reducing the tone frequency proportionately. If the preset counter 229 counts down, P/N1's HF divisors become progressively smaller, and the TP and tone frequencies increase correspondingly.

The state of the J-K flip flop 852 implements the direction of the counter 229 count. If flip flop 852 is set, its high Q-output causes counter 229 to count up; and if flip flop 852 is reset, its low Q-output causes counter 229 to count down. The initial state of flip flop 852 in a given tone frequency change is determined by one of two possible signals from the SIPO. Thus, the flip flop 852 may be first set by a 1-bit SIPO signal to OR gate 854, which drives the J-input of flip flop 852 high and causes the 1-shot flip flop 850 to pulse the clock input of flip flop 852 whose Q-output then goes high. Or flip flop 852 may be first reset by a different 1-bit signal, to OR gate 855, which drives the K-input of flip flop 852 high and triggers the 1-shot flip flop 860 to pulse the clock input of flip flop 852, making that flip flop's Q-output low.

Some changes in tone frequency of organ pipes during tonal attack or decay reverse their direction before the changes themselves finally terminate. FIG. 14 shows the P/N5 count-cycle code as applied also to EXNOR gates 863, together with a 3-bit SIPO signal representing a selectable point in the P/N5 count cycle, intermediate between the beginning and end of a tone frequency change. When the P/N5 count-cycle code and the SIPO signals correspond at the selected intermediate point in the P/N5 count cycle, the outputs EXNOR gates 863 go high. If the indicated 1-bit SIPO signal on AND gate 856 is also high as a condition of count reversal, a resulting high output of AND gate 856 is applied to the AND gates 854 and 855. Since a tone frequency change is already under way, the J or the K input of flip flop 852 is already high. The high output of OR gate 855 or 854 then renders the other input of flip flop 852 also high and triggers one of the flip flops 860 or 850.

Such triggering, in combination with the high J and high K inputs of flip flops 852, toggles flip flop 852, reversing the state of its Q-output, the direction of the count by preset counter 229, and the direction of the change in the TP and tone frequencies.

It is evident that, during a given instance of tonal attack or decay, additional instances of change in TP and tone frequencies or additional reversals of their directions of change can be implemented by additional 4-bit SIPO signals and corresponding gates.

The possible range of magnitude of a change in a TP frequency corresponds to the counting range of which a counter 226 is capable, and the speed of such changes varies inversely with the selectable number of counter 226 counts before each recurrent resetting. The extreme tone frequencies (e.g., 16,744.036 hertz and 8.176 hertz) of the largest (11-octave) organs in existence differ by a factor of 2,048, as would comparable relative changes in such frequencies during tonal attack or decay. However, in my invention, tone frequencies are a direct function of TP frequencies which may range only from 4 kilohertz to 60 kilohertz, which frequencies differ by a factor of only 15. This smaller, TP frequency range makes it possible for my invention to implement comparable relative changes in widely varying tone frequencies by the illustrative means. Thus, the illustrative 12-stage counter 226, clocked at the illustrative 2 megahertz frequency, implements tone frequency changes of up to at least 10% of nominal frequencies during time intervals of attack or decay which are characteristic of the various pitches throughout the range of an 11-octave instrument.

Transient changes in the relations between the phases of different harmonics of given notes are detectable during the tonal attack or decay of some organ pipes. Such effects are readily duplicated by my invention, by generating a first set of a tone's harmonic by means of a first tone unit, and further sets of the tone's harmonics by means of further tone units, and by presetting the respective SIPOs of the different units to cause the frequencies of the various sets of harmonics to undergo changes which differ relative to each other.

Further details of the adaptable keying phase control will now be described. This is the part of the circuit which responds to full depression and full release of any key and controls those other parts of the circuit which in turn control events during the various keying phases. Means for generating initial transient tones and terminal transient tones are also provided. The circuit also responds to premature complete release or depression of a key and to setting or resetting of a voice stop.

Figure 6:
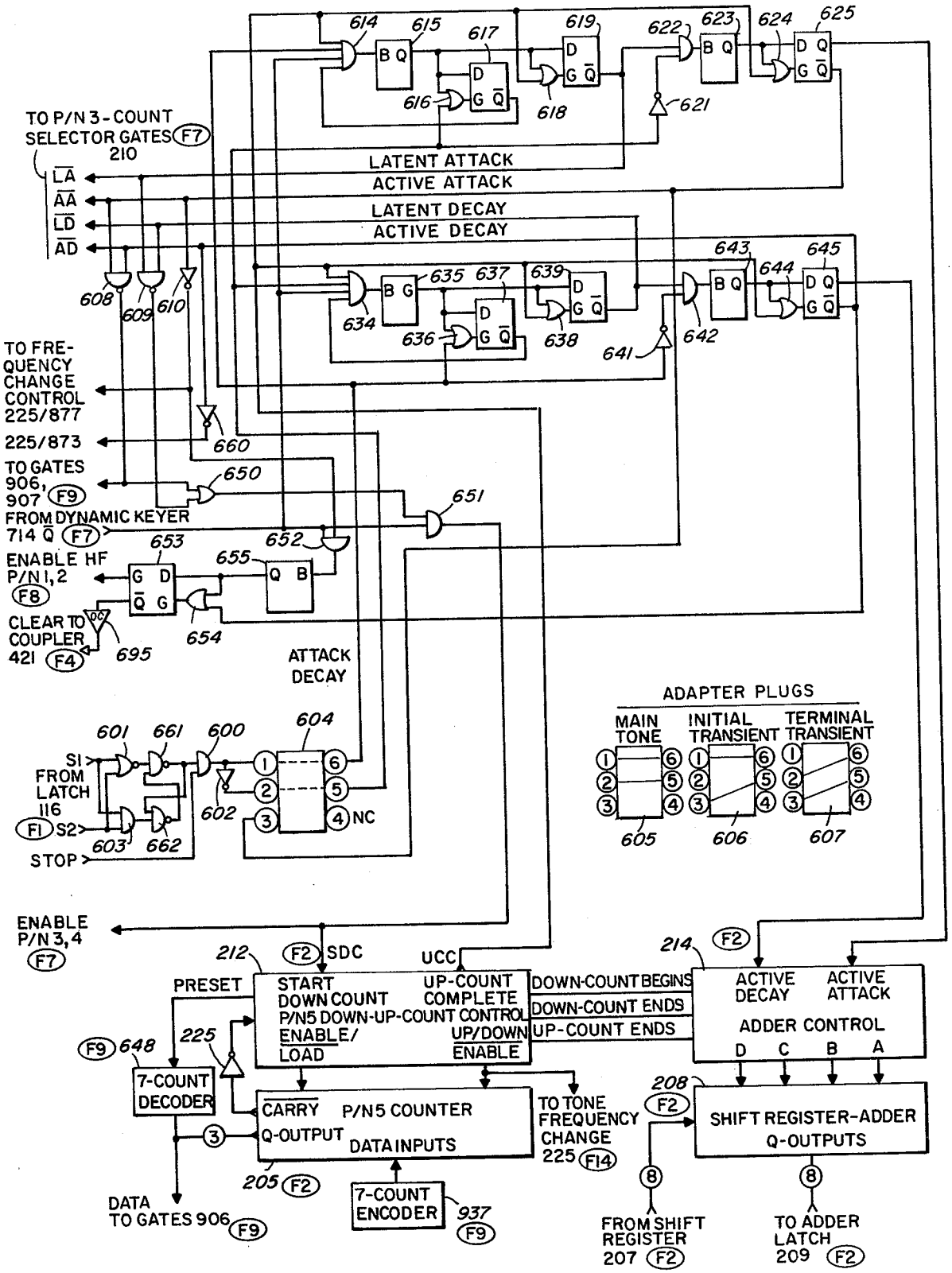

FIG. 2 shows a (keying-) phase control 211, various outputs of which are applied to the selector gates 210, the P/N6 counter 206, the P/N5 control 212, and the shift register-adder control 214. FIG. 6 shows the phase control 211 as comprising various elements numbered between 600 and 662 inclusive. The adapter socket 604 and the adapter plugs 605, 606, 607 shown in FIG. 6 are simple illustrative means of adapting a tone unit to the generation and switching of different types of tones. (Three-position switches effect such adaptions just as readily.) A main tone turns on when a key is depressed and a stop is set, and turns off when the key is released or the stop is reset. An initial-transient tone turns on and then off when a key is depressed and a stop is set. A terminal-transient tone turns on and then off when a key is released or a stop is reset.

As shown in FIG. 6, the key-state-change signals from key springs S1 and S2 (collectively symbolized by S) and the voice stop signal (symbolized by V) are applied to gates 601, 603, and the inverter 602. Gate 600 applies a high logical, attack signal to terminal 1 of the adapter socket 604 when the coupled key is completely depressed and the corresponding voice stop is set. Inverter 602 applies a high logical, decay signal to terminal 2 of the adapter socket 604 when the key is completely released or the stop is reset.

From the above disclosure, it is understood that partial depression or release of a key initiates a key-speed count by a dynamic keyer, and that complete depression or release terminates the speed count. Key-state signals from complete key depression or release are applied simultaneously to the dynamic keyer and associated phase control. Considering first the operation of a phase control 211 when the adapter socket 604 is plugged by adapter plug 605 for a main tone, it is seen that a signal signifying the end of the dynamic keyer's speed count combines at gate 614 with the ATTACK output of socket 604 terminal 6, the $\overline{Q}$-output of reset flip flop 617, and the quiescent UCC ("up-count complete") signal from the P/N5 control 212, to trigger the one-shot multivibrator 615. This multivibrator's Q-output pulse sets flip flop 619, whose low $\overline{Q}$-output is the latent attack ($\overline{LA}$) signal. Through gates 609, 650, and 651, the LA signal starts counter P/N5's (205) down-count, and enables counters P/N3 (203) and P/N4 (204) at the end of the dynamic keyer's key-speed count. The $\overline{LA}$ signal itself enables the Latent Attack gates of the group of selector gates 210 (see FIG. 7), to preset the P/N3 counter 203 to count a corresponding phase duration. As noted, the output of AND gate 651 also starts a down-count by the P/N5 counter 205. When the ensuing up/count by P/N5 is complete, the resulting UCC signal from the P/N5 control 212 resets flip flop 619, thereby turning off its $\overline{LA}$ output signal (that is, driving 619's Q high), and disabling counters P/N3 and P/N4.

The high $\overline{Q}$ output of the reset flip flop 615 combines with the high output of inverter 621 on gate 622 to trigger flip flop 625 whose low $\overline{Q}$ output constitutes an active attack ($\overline{AA}$) signal. The resulting high output of inverter 610, acting through gate 652, triggers flip flop 655, thereby setting flip flop 653 and enabling the HF selector counter 809 and counters P/N1 and P/N2, for generation of the tone frequency. The next UCC signal then resets flip flop 625, again disabling counters P/N3 and P/N4 and terminating active attacks.

The initial triggering of the multivibrator 615 had also set flip flop 617, whose low $\overline{Q}$-output had disabled gate 614 so as to prevent repeated setting of flip flop 619 when the UCC signal recurs, ending latent attack and initiating active attack. (During latent or active decay, the absence of an ATTACK signal on gate 614 prevents setting of flip flop 619 and, therefore, of flip flop 625 by UCC signals recurring during those phases.)

It is noted in FIG. 6 that the active attack $\overline{AA}$ signal enables the active attack selector gates 210. Acting through gate 652, the AA signal from inverter 610 triggers flip flop 665 and sets flip flop 653, thereby enabling the HF selector 215 and counters P/N1 (216) and P/N2 (217). Also, the AA signal, acting through gate 608, enables gates 906 to transmit counter P/N5's changing Q-output signals which preset counter P/N6 (206). Through gate 650, the AA signal again initiates the P/N5 205 downcount for the active attack phase, and enables counters P/N3 and P/N4. Thus, the AA signal initiates all the conditions necessary to the generation of the tone frequency, and the generation and duration of an active attack keying envelope.

It is further noted that the high $\overline{Q}$-output of the dynamic keyer flip flop 714 in FIG. 7, indicating the end of an up-count by counter 706, is also applied to phase-control gates 651 and 652, thereby permitting the HF selector and counters P/N1–P/N4, inclusive, to be enabled only after the outputs of dynamic keyer counter 706 have reached a variously determined maximum value which determines the value by which counter P/N4 divides the output frequency of counter P/N3. (Although the S1, S2 key signal latches 116 had been set by the coupler's flip flop 420 Q-output signal whose setting of latches 116 initiated counter 706's up-count, and the S1, S2 signals were applied to the phase-control gates 601, 603, only resulting ATTACK or DECAY signals initiate phase signals, and, as noted, these signals enable the required counters only when the $\overline{Q}$-output of the dynamic keyer flip flop 714 is high.)

When the key remains depressed until the active attack phase is complete, the UCC signal resets flip flop 625, and the resulting low output of gate 608 disables counters P/N3 and P/N4. However, with completion of the active attack, the HF selector 215 and counters P/N1 (216) and P/N2 (217) remain enabled by the set flip flop 653, and gates 907 are enabled by the low signal from gate 608, thus sustaining audible tone frequency generation as long as the key is not completely released and the stop remains set.

Should the key be completely released or the stop be reset before a latent attack phase is complete, that phase will still run its course until the UCC signal resets flip flop 619, but the presence of the DECAY signal from terminal 6 of adapter socket 604 causes the inverter 621 to disable gate 622, thereby preventing the high $\overline{Q}$ signal from flip flop 619 from triggering the multivibrator 623 and so initiating an active attack phase. Should the key be completely released or the stop be reset before an initiated active attack phase is complete, the phase will still run its course until the UCC signal resets flip flop 625, so that the latent decay phase can begin when the key is completely released or the stop is reset.

It will be noted that the circuit comprising elements 634–645, inclusive, is identical to the circuit comprising elements 614–625, inclusive, except that the inputs to gates 614 and 634 of these circuits from terminals 5 and 6 of the adapter socket 604 are interchanged. Thus, complete release of the key or resetting of the stop produces latent and active decay phases, just as complete depression of the key and setting of the stop produce latent and active attack phases. Interruptions of current latent or active decay phases by depression of the key and setting of the stop proceed just as do interruptions of latent or active attack by complete release of the key or resetting of the stop. It is noted that complete release of the key or resetting of the stop resets flip flop 617, and that complete depression of the key and setting of the stop reset flip flop 637.

It is noted, further, that only a low $\overline{AA}$ or a low $\overline{AD}$ signal enables the NAND gate 608 to transmit a high signal to inverter 905 (see FIG. 9), enabling the P/N5 counter 205 and gates 906 to apply to P/N6 counter 206 the changing presetting values which in turn enable P/N6 to effect the amplitude changes characteristic of active attack or active decay. (The corresponding functions of P/N6 and its associated shift register 207 and register-adder 208 have been indicated above.)

When flip flop 645 resets at the end of active decay, the high $\overline{Q}$ output of flip flop 645 resets flip flop 653, thereby disabling the unit's HF selector counter 809 and counters P/N1 and P/N2, and supplying a partial condition for clearing the section's coupler 107. The coupler 107 actually clears only when the high signals from the open-collector buffers 695 of all the section's units are present on the coupler's flip flop 421. This latter condition guarantees that no tone generated in any of the section's units will be cut off before its active decay phase is complete.

When an initial-transient plug 606 is inserted in the adapter socket 604, the resulting connection of terminal 1 to terminal 6 turns on the transient tone corresponding to its SIPO 222 presettings when the key is also completely depressed and the stop is set. The plug's further connection of terminal 3 to terminal 5 applies the high $\overline{Q}$ output of reset flip flop 625 to gate 634, so that latent decay and then active decay ensue directly upon completion of the active attack. Complete release of the key or resetting of the stop before the transient tone's indicated phases are all complete does not prevent their completion, because the initial-transient plug 606 does not connect a DECAY signal to the phase control circuits.

When a terminal-transient plug 607 is inserted into the adapter socket 604, the resulting connection of terminal 2 to terminal 6 enables the DECAY signal to turn on the terminal-transient tone when the key is completely released or the stop is reset. The plug's connection of terminal 3 to terminal 5, as with the initial-transient tone, allows latent decay and then active decay of the terminal-transient tone to follow directly upon completion of the active attack phase. Again, since the terminal-transient plug does not connect an ATTACK signal to the phase control, terminal-transient tones, once initiated, complete all their four keying phases when the key is again completely depressed during any of the phases.

The inability of early complete key depression or release, or of corresponding stop setting or resetting, to interrupt transient tones once they have been initiated, enables the inventive instrument to duplicate the behavior of organ pipe transient tones under corresponding keying conditions.

As noted above, an active attack phase can be prevented by premature, complete release of a completely depressed key, and an active decay phase can be prevented by premature, complete depression of a completely released key. Also, as noted, premature partial release of a completely depressed key cannot prevent an active decay phase, premature partial depression of a completely released key cannot prevent an active attack phase, and no key action can prevent completion of any initiated but incomplete keying phase. However, as will now be described, certain key movements between complete and partial depression or release can modify the duration of, and rates of tonal amplitude change within, latent and active keying phases.

Referring to FIG. 7, it is seen that, when a completely depressed key is partially released and then completely depressed again before a latent attack phase is complete, the momentary setting of flip flop 714 clears the dynamic keyer counter 706 and initiates a new up-count by it. Because the P/N4 counter 204 remains enabled until a high $\overline{Q}$ signal from flip flop 645 appears (signifying completion of an active decay phase), clearing and recount of counter 706 cause the count rate of P/N4 first to drop to zero and then promptly to increase gradually with the counter 706 up-count, to a value determined by the repeated, complete key depression or the carry output signal of counter 706. Because the P/N5 counter 205 (FIG. 9) is clocked by the output of P/N4 counter 204, the count rate of P/N5 counter 205 will first drop to zero, then rise gradually. Thus, the additional time required by the indicated key movements will increase the duration of the interrupted, latent attack phase, while lower counter 706 counts (which increase the count rate of P/N4 counter 204 and, hence, of P/N5 counter 205) which may result from briefer, repeated depression of the key, will limit such increases in the duration of the latent attack.

When the above key motions occur during an active attack phase, the corresponding changes in the binary output of the P/N5 counter 205, which variously preset the P/N6 counter 206 (FIG. 9), will momentarily halt, then promptly and gradually continue the tone's active attack. The net, heard result of such events will usually be a somewhat longer overall attack phase during which its rate may undergo an increase or decrease.

Partial release, then immediate complete depression, of a key after active attack is complete will initiate another up-count by the dynamic keyer counter 706, and the count rate of P/N4 will respond accordingly. However, the repeated complete key depression does not initiate a new latent or active attack phase, because the absence of a high DECAY signal from the adapter socket 604 output terminal 5, and on the OR gate 616 and inverter 621 of the phase control (FIG. 6), prevents the triggering of flip flop 615 or flip flop 623, whose triggering is a condition of such initiation. Accordingly, a sustained note will only continue sounding during the indicated, temporary, partial key release, the result of the dynamic keyer counter 706 up-count will be without further effect, and the counter 706 will be cleared by the next new key state signal to the dynamic keyer.

It can be seen that the durations of latent or active decay phases are modified analogously by the circuit, by first partially depressing and then completely releasing again, a key which has just undergone an initial, complete release. It is further apparent that the durations of initial and terminal transient tones are subject to similar modification by the indicated patterns of keying.

My invention also comprehends a presettable, cross-coupled, precision decoupling system, enabling duplication of the acoustic decouplings of pluralities of tone sources distributed spatially in two-dimensional horizontal arrays, by various presettable, precise electrical decouplings of pluralities of tone frequency currents corresponding to the said tone sources. Said system includes a plurality of pitch decouplers, each of which variously decouples the tone frequency currents for the various pitches comprised by a stop voice, the outputs of the said plurality of pitch decouplers being cross-coupled to the inputs of two voice decouplers. The first of said voice decouplers variously decouples combined currents received from first outputs of the said plurality of pitch decouplers, and the second of said voice decouplers variously decouples combined currents received from second outputs of the said plurality of pitch decouplers. The four outputs altogether of the said pair of voice decouplers are applied respectively to four amplifier-speaker systems. Each of the four amplifier-speaker systems receives a separate one of the two outputs of one of the two voice decouplers. The speakers are distributed spatially in a horizontal, two-dimensional array so that speakers nearer a listener emphasize tones to be heard as more proximate, speakers farther from the listener emphasize tones to be heard as more distant, speakers toward the listener's left emphasize tones to be heard as coming from the left, and speakers toward the listener's right emphasize tones to be heard as coming from the right, with tones to be heard as coming from the various locations intermediate between the said speaker locations being binaurally heard as coming from the said intermediate locations.

Each decoupler (whether pitch decoupler or voice decoupler) comprises any desired plurality of analog tone frequency inputs, a corresponding plurality of pairs of binary multiplying-factor word-inputs, the said pair of multiplying factors of each tone frequency input being selected to be equal to each other or to differ positively or negatively relative from each other, and to equal or differ from the magnitudes of multipliers of other tone frequencies which are applied to the said decoupler's other inputs. Each tone frequency input channel branches and is applied to the reference-voltage inputs of a pair of multiplying digital-to-analog converters (MDAC's), the first binary multiplying factor word being applied to the said first MDAC, the second binary multiplying-factor word being applied to the second said MDAC, and the outputs of said pairs being combined through mixing resistors into two channels constituting the two multi-channel outputs of the said decoupler. The variously multiplied tone frequencies in the outputs of each of the said decouplers are mutually decoupled electrically in proportion to the generated differences between their respective amplitudes, thereby effecting corresponding reductions in the amplitudes of beats in either output of the decoupler, and effecting corresponding enhancements of fluctuations between the relative amplitudes of similar tone frequencies, between the said decoupler's two outputs.

The first output of each of said pitch decouplers is applied to one of a plurality of inputs to the first said voice decoupler, the second said output of each said pitch decoupler being applied to a corresponding one of a plurality of inputs to the second said voice decoupler, fixed multiplying-factors being applied to the said inputs of the said voice decouplers, the said multiplying-factors differing more or less between the different inputs of each said voice decoupler but being the same for corresponding inputs of the two said voice decouplers, thereby rendering the decoupling of pitches non-interactive with that of voices.

Figure 10A:
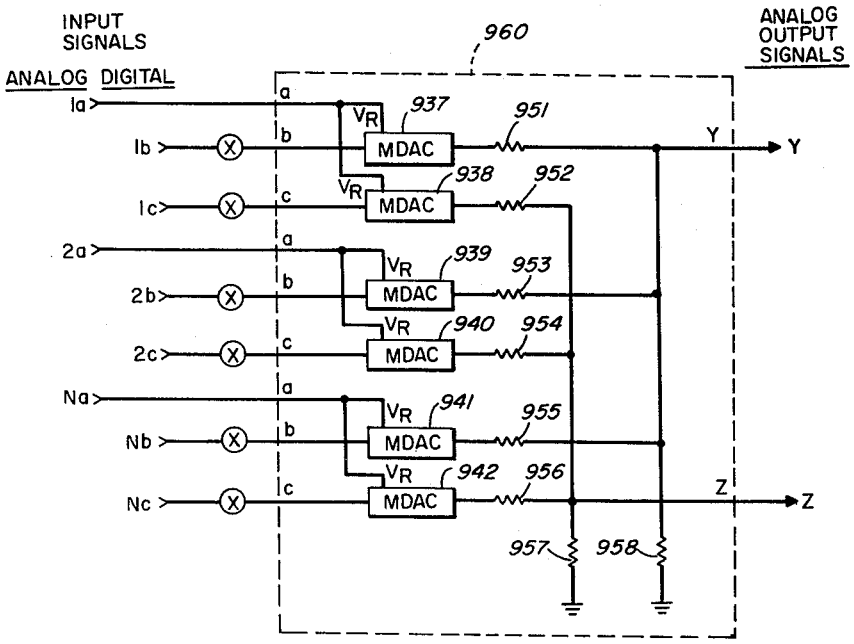
FIG. 10A is a diagram of an illustrative, presettable, precision decoupler for variously decoupling three illustrative analog, alternating currents.

FIG. 1 shows the illustrative tone units (121, 122 or 126, 127) for each voice as being coupled to pitch decouplers 124, 129 for their voices. FIG. 10A shows illustrative portions of a standard, presettable, precision decoupler for variously decoupling N analog signals from each other. It is understood that such a decoupler can variously decouple any desired number of analog signals, through incorporation of an additional pair of multiplying digital-to-analog converters (MDACs) and their associated resistors into the decoupler, for each additional signal to be decoupled. In the figure, each analog signal is shown as applied to the reference-voltage ($V_R$) inputs of a pair of MDACs (e.g., 937, 938), and X-bit digital signals b and c as applied respectively to the c-switching-inputs of the corresponding MADCs. The respective amplitudes of the analog-signal Y- and Z-outputs of such a pair of converters are linear functions both of the magnitudes of the converters' analog reference-voltage input and of the binary values of the converters' switching digital inputs. When the outputs of two or more converter pairs are combined through preferably equal mixing resistors (e.g., 951–956, inclusive) into two channels Y and Z, as shown in the figure, then channel-Y contains a mixture of the b-amplified analog signals, and channel-Z contains a mixture of the c-amplified analog signals. The greater the differences between the amplitudes of any two or more signals combined within a Y- or Z-channel, the smaller will be the coupling, and the corresponding amplitudes of beats, between such signals. When the corresponding Y and Z signals are radiated stereophonically moderate beats and variously prominent lateral movements of the tones are heard. Such perceived movements and moderated beats, which result from the spatial dispersions of optimally mistuned organ pipes, and the spatial separation of a listerner's ears, are characteristic of the chorus efforts of pipe organ sound.

Figure 10B:
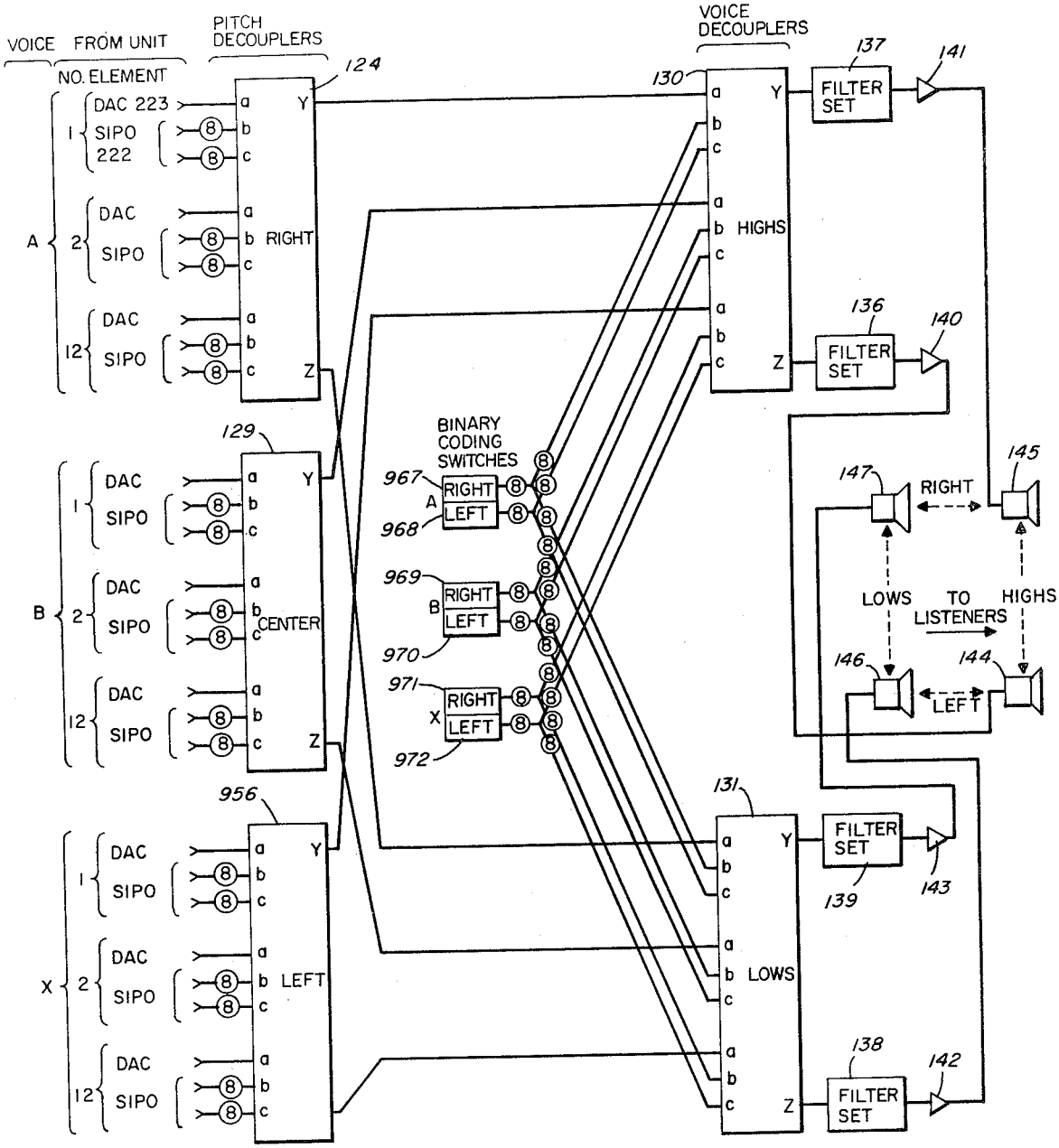
FIG. 10B is a diagram of an illustrative cross-coupled decoupler system comprising portions of three illustrative, pitch decouplers for variously decoupling tone frequencies for different pitches within voices, and of two voice decouplers which variously decouple the sets of tone frequencies for different voices in a digital transfer organ, with the pitch and voice decouplers being cross-coupled so as to enable four amplifier-speaker systems to duplicate the sounds of optimally mistuned organ pipes spatially distributed in two horizontal dimensions.

FIG. 10B shows a cross-coupled system of decouplers which are represented by the block symbols 124, 129, 130, 131, and 956. Three illustrative tone current inputs (out of a possible twelve) are shown in each pitch decoupler 124, 129, and 956, and three illustrative tone current inputs (out of X such inputs) are shown in each voice decoupler 130, 131. It is understood that each of such decouplers can be expanded as described above, so as to decouple other tone currents not shown in FIG. 10B. Also, as implied, each such converter and resistor is identical to every other.

FIG. 10B shows each a-input of each pitch decoupler as receiving analog signals from a 10-bit DAC (e.g. 223). FIG. 2 shows the illustrative 10-bit DAC 223 as receiving a 9-bit signal from the adder latch 209. Each DAC in a voice receives such signals from its corresponding tone unit.

Bit-configurations and their relations in eight circuit elements

| PROM 123 | Write Data Gates 220 | RAM 219 | Read Data Gates 213 | Shift Register 207 | Register Adder 208 | Adder Latch 209 | DAC 223 |
|---|---|---|---|---|---|---|---|
| LSB 1 | 1 | 1 | 1 | 1 | 1 | 1 | (1=0) 2 |
| 2 | 2 | 2 | 2 | 2 | 2 | 2 | 3 |
| 3 | 3 | 3 | 3 | 3 | 3 | 3 | 4 |
| 4 | 4 | 4 | 4 | 4 | 4 | 4 | 5 |
| 5 | 5 | 5 | 5 | 5 | 5 | 5 | 6 |
| 6 | 6 | 6 | 6 | 6 | 6 | 6 | 7 |
| 7 | 7 | 7 | 7 | 7 | 7 | 7 | 8 |
| 8 | 8 | 8 | 8 | 8=0 | 8 | 8 | 9 |
| | | | | | | 9 | 10 |
| MSB — | — | — | — | — | — | — | — |

The table summarizes the bit-configurations in eight elements of the inventive circuit, which receive, process, and transmit digital representations of tone frequency current waveforms. The table also shows the relations between the configurations in the different elements.

Thus, words comprising 8 bits are stored in voice PROMs 123 on a sign magnitude scale, with the eighth bit (MSB) being the sign bit. The write data gates 220 transmit such words to RAMs 219. The read data gates 213 then transmit only the 7 least significant bits (the magnitude bits) to the shift register 207, as shown in the table. The read data gates 213 transmit the eighth (or sign) bit directly to the 9th-bit position of the adder latch 209.

The shift register 207 variously shifts its received 7-bit words out of its 7 least significant positions, with its 8th bit being held at zero. The shift register 207 then trnsmits 8-bit words (in which the eighth bit is always zero) to the shift register latch 226 and shift register adder 208. The summations of 7-bit constant words and 7-bit complement words by the shift register adder 207 often carry a 1-valued bit into the adder's 8th-bit position. The shift register adder 208 transmits its 8-bit output words to the eight least significant positions in the adder latch 209 which therefore receives altogether 9 bits on a sign-magnitude scale. The adder latch 209 transmits these 9-bit words to the 9 most significant positions of the DAC 223 whose first, or least significant, bit is held at zero. This inter-element shift in bit-configuration simply enables the analog output voltage of the DAC 223 to vary throughout 99.9% of its full possible range. The DAC 223 is so connected as to put out bipolar AC analog voltages having a zero DC component. This zero DC component precludes DC surges during the active attack and decay of tone currents, effected by the shift register 207 and shift register adder 208.

During a given note's tonal attack or decay, the binary output of the shift register adder 208 can assume up to 15 different relative values ranging from zero to a value representing the note's maximum amplitude. Such values may be any of those on a scale ranging from zero to 254. These facts define the degree of amplitude resolution possible through the indicated switching means. While application of the signbit to the DAC 223 doubles the effective range of the binary values of the DAC 223 input, such doubling leaves the indicated resolution as such unaltered.

In the illustrative cross-coupled decoupler system shown in FIG. 10B, the two corresponding 8-bit inputs to a given converter-pair in a pitch decoupler are given values which generate relatively higher amplitudes of higher tone frequencies and relatively lower amplitudes of lower tone frequencies in the pitch decoupler's Y-output channel, and relatively higher amplitudes of lower tone frequencies and relatively lower amplitudes of higher tone frequencies in the pitch decoupler's Z-output channel. By such means, each of the illustrative pitch decouplers 124, 129, 956 variously decouples different pitches within its corresponding voice.

Also, the illustrative pitch decouplers are seen to be labeled respectively Right, Center, and Left, corresponding to illustrative voice pipe files located toward the right, center, and left of a total pipe array. Such a location is referred to as the lateral spatial position. Such an illustrative arrangement is characteristic of contemporary pipe organ architecture. FIG. 10B shows the Y-outputs of the three illustrative pitch decouplers as applied to the a-inputs of corresponding converter-pairs of the voice decoupler 130, and the Z-outputs of the pitch decouplers are applied to the a-inputs of the converter-pairs of the voice decoupler 131. This cross-coupling of the pitch and voice decouplers enables the voice decoupler 130 to variously decouple the higher tone frequencies of the different voices from each other, and voice decoupler 131 to variously decouple the lower tone frequencies of the different voices from each other. Thus, the two voice decouplers contribute in equal or various differing degrees to the decoupling of intermediate pitches in different voices, depending on the levels of the pitches.

The degrees of the various decouplings by the voice decouplers 130, 131 are determined by the magnitudes of binary signals from illustrative binary-coding switch arrays 967-972, inclusive. Each switch array is seen to apply a same 8-bit signal to corresponding b- or c-inputs of voice decouplers 130, 131. Thus, higher tone frequencies in a given voice are amplified in decoupler 130 to the same degrees that lower tone frequencies in the given voice are amplified by decoupler 131. That is, the voice decouplers amplify the Y-channel and Z-channel signals from a given pitch decouplers by a same distinctive factor, thereby rendering voice decoupling non-interactive with the pitch decoupling.

The Y- and Z-channel outputs of the voice decouplers 130 and 131 are applied (through filter sets 136–139, inclusive, described below) respectively to four speaker systems whose speakers have the illustrative spatial arrangement shown in FIG. 10B, so that speakers 146, 147 emphasize lower pitches (heard as from a location farther from a listener, as in many contemporary pipe organs), speakers 144, 145 emphasize higher pitches (heard as from a location nearer to a listener), speakers 144, 146 emphasize voice notes heard as coming from directions toward the listener's left, and speakers 145, 147 emphasize voice notes heard as coming from directions toward the listener's right. The difference in location of apparent origin of sound from speakers 146, 147 and speakers 144, 145 is referred to as a difference in the distance-from-listener dimension. It is understood that, by virtue of the two-dimensional stereophonic system shown in the figure, all intermediate pitches and voices are perceived binaurally as coming from various intermediate locations within the four-speaker array. The resulting, overall acoustic sound image duplicates that of organ pipes which are distributed in the illustrative, horizontal, two-dimensional array, with corresponding extensional, directional, and decoupling effects duplicating those of such organ pipe arrangements.

As noted, FIG. 1 shows the outputs of the two voice decouplers as applied to four multiresonant filter sets. In 1973, Mathews and Kohut of the Bell Telephone Laboratories enabled a case-less violin to simulate a high quality violin, by applying the outputs of electromagnetic pickups of the string vibrations to an array of high Q filters whose composite transfer characteristic displayed an array of amplitude peaks and valleys approximating the resonances of the quality instrument. As the playing moved from one pitch to another, or when it produced a violin vibrato, not only the heard pitch, but also the tonal timbre, changed and fluctuated. Particular patterns of such further effects were found to distinguish the sound of violins of different quality. Mathews and Kohut observed that, "oscillators used in electronic organs are candidates for (multi-) resonant filtering", but described no further means for enabling an electronic organ to duplicate the multiresonances of pipe enclosures. My calibrations of the resonances at various locations within the pipe chamber of a particular pipe organ yielded a characteristic curve having 144 peaks distributed over a frequency range from 36 Hz to 5 KHz at one location, and confirmed that other locations within the pipe chamber had different and distinctive multiresonances.

Figure 11:
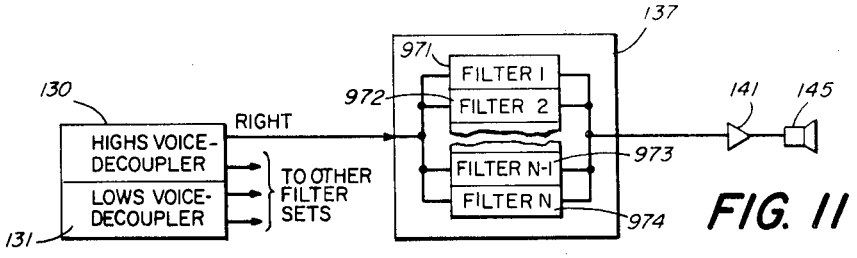

FIG. 11 shows illustrative portions of an illustrative filter set 137 receiving analog tone signals from the voice decoupler 130. As shown in FIG. 10B, this particular filter set couples voice decoupler 130 to amplifier 141. The three other multiresonant filter sets, having respectively different overall transfer characteristics, couple the other three outputs of the voice decouplers to the corresponding amplifiers shown in FIG. 10B. Midband gains, center frequencies, and bandwidths of such filters are established so that their set as a whole reproduces the distributions of amplitude reenforcements and attenuations characteristic of a given location within a pipe chamber, e.g., an interior corner of the chamber. Four different filter sets, for the four corners, then enable a transfer organ to duplicate the complex effects of intra-enclosure sound reflections and refractions, when the amplified outputs of the four sets are applied as shown, to correspondingly located speakers.

In FIG. 11, N signifies the total number of filters in a given filter set. Each filter in such a set is a bandpass filter having a maximum output amplitude at a frequency corresponding to the tone frequency at a peak in the complex resonance curve of a given location in an organ pipe enclosure whose multiresonant effects are to be duplicated. Thus, a filter set corresponding to the example cited in the second paragraph above would comprise 144 fiters. The included filters are preferably active filters well known to those familiar with electronic filter design. Such design requires the selection of resistors and capacitors so as to lend each filter a particular midband gain, center frequency, and bandwidth. Such selection and design are facilitated by reference to charts in John L. Hilburn and David E. Johnson's Manual of Active Filter Design (New York, McGraw-Hill, 1973). The combination of such filters into a filter set, as effected by Mathews and Kohut (The Journal of the Acoustical Society of America, Volume 53, Number 6 (1973) pages 1620–1626),follows established practice in combining filter inputs and outputs, respectively.

The result of the circuitry of FIG. 11 is to provide an enclosure-effects generator, comprising four multiresonant filters receiving respective sets of tone frequency currents, and transmitting modifications of the said currents such that currents of different frequencies are variously reenforced or attenuated according to the overall transfer characteristics of the filters, with the said reenforcements and attenuations corresponding to those resulting from sound reflections and refractions at four corresponding points in a partially open enclosure containing spatially distributed sound sources, with the outputs of the said multiresonant filters being applied to four amplifier-speaker systems whose speakers have relative locations corresponding to the said four locations within the said soundsource enclosure, the characteristic patterns of sound reenforcement and attenuation at the said locations being reproduced by the sounds radiated by the correspondingly placed speakers, the resultant overall binaural sound image corresponding to that of a plurality of sound sources distributed within the said partially open enclosure.

Ten conditions require satisfaction in duplication of 25 of the 26 known musical properties of pipe organ sound by electronic means. The present inventive organ satisfies the ten conditions as follows: (1) Random phase independence of notes is effected by randomly varying differences between P/N4 counts for different notes on their successive concurrent keyings by the same key or different keys. (2) Optimal mistune of individual notes is effected by various combinations of presettings of cascaded P/N1 and P/N2 counters which divide a high frequency current. (3) Individualized tone frequency changes during tone switching are implemented by counters which continuously increment or decrement the count rate of P/N1 in selectable amounts and sequences, at selectable rates, and at selectable times, during tonal attack and decay. (4) Individual waveforms for the separate notes are effected by note-forming information temporarily transferred through key depression, from automatically preprogrammed or fabricated voice memories to temporary memories within small numbers of standard tone generating and switching units. (5) Individual sigmoid switching envelopes are effected by the counters P/N5 and P/N6, the shift registers, and register-adders in such units. (6) Initial- and terminal-transient tones are generated by simply adapted tone units. (7) Expressive playing of individual notes, as in a tracker action pipe organ, is effected by dynamic keying circuits. (8) Precise, independent decouplings of pitches and voices are effected by a cross-coupled precision decoupler system. (9) Organ pipe-enclosure effects are produced by differently constituted, multiresonant filter sets which energize corresponding amplifier-speaker systems. (10) Spatial locations of individual notes, corresponding spatial extension of the overall sound image of an instrument, and related chorus effects, are effected by application of optimally mistuned and variously decoupled tone frequency currents to a two-dimensional stereophonic speaker system. An eleventh general condition, for duplicating the moderate and musical, quasi-random fluctuations in the pitch, loudness, timbre, noise content, and spatial locations of individual tones, which variously reflect wind-pressure fluctuations, vibratos, air-turbulence, and wind-noise, is readily satisfied by minor adaptations of various means within the prior art to the inventive organ. General expression controls (e.g., swell pedals) are readily made to alter the gains of preamplifiers of the inventive organ's sound system. The inventive organ is compatible with various means in the prior art for coupling between keyboards. Modular construction permits straightforward duplication of pipe organs of any size or kind.

I claim:

1. An electronic transfer organ, comprising in combination:

a keyboard having a multiplicity of keys, each said key corresponding to at least one of a multiplicity of nominal pitches to be sounded;

stop means having at least one stop, each said stop corresponding to a voice to be sounded;

at least one large memory for each voice, each said large memory having stored therein individualized information comprising at least the amplitude, waveform, frequency, keying phases, and spatial position in the distance-from-listener dimension of each of said nominal pitches to be sounded;

at least one array of small memories corresponding to each said large memory, said small memories being substantially identical to each other, the number of said small memories in each array being equal to the number of keys that may be desired to activate concurrently;

means responsive to depression of any key to activate one of said small memories in each array to receive information and cause transfer from each of said corresponding large memories of the said individualized information including said spatial position therein corresponding to that depressed key to the respective small memories corresponding to the depressed key for temporary storage therein;

means for causing activation of any stop to convert the information temporarily stored in each small memory corresponding to that stop and the depressed key into a signal corresponding to the information so stored, there being a said signal corresponding to each note, each said signal being individualized with respect to amplitude, waveform, frequency, and keying phases;

means responsive at least to said transferred spatial position information when a key is depressed, for generating at least four composite signals from said transferred individualized signals, each said composite signal representing a distinctive combination of the amplitudes, waveforms, frequencies and keying phases of its comprised individualized signals;

separate switch means for each voice for producing a pair of amplitude-multiplication factors characteristic of the lateral spatial position of that voice; and means responsive to said four or more composite signals and said pair of amplitude-multiplication factors for generating sounds whose combined acoustic sound image approximates the acoustic sound image of a multiplicity of individualized sound sources distributed in at least two orthogonal spatial dimensions.

2. An electronic transfer organ according to claim 1, wherein said keyboard includes (a) two switches, means for each key responsive to key movement adapted to produce a debounced, two-component signal upon any change of state of said key: (b) a single sequencer-counter adapted to count sequentially through a sequence of count values constituting codes identifying each of said keys; (c) a sequencer-decoder adapted to scan said keys in succession in response to said sequence of count values; (d) means for temporarily disabling said sequencer-counter when it reaches a count value corresponding to a key producing a key-state-change signal; (e) means responsive to said temporary disablement for transmitting said count value to said transfer-causing means; and (f) means responsive to signals from said transfer-causing means for enabling said sequencer-counter.

3. An electronic transfer organ according to claim 2, wherein said transfer-causing means includes means for identifying sections to which keys are not currently coupled and making said uncoupled sections available for coupling and transfer; and wherein each of said sections includes a section coupler comprising (a) means for storing said count value transmitted from said sequencer-counter in an available section unless said count value is already stored in another section, thereby coupling the key corresponding to said count value to said section within which said section coupler is included; (b) means responsive to said storing for initiating said transfer; (c) means responsive to completion of said storing, for initiating a count by a dynamic keyer counter; (d) means enabling a coupled section to respond to further key-state-changes signals produced by the key to which it is coupled; and (e) means for uncoupling a coupled section after the conversion into sound caused by depression of said key has ceased.

4. An electronic transfer organ according to claim 3, wherein said keyboard includes at least two switches for each key so positioned that upon depression of said key, said key successively closes said switches, and upon release of said key, said key successively opens said switches in the reverse order, whereby key-state-signals are produced in at least the sequence (i) partial depression (ii) full depression (iii) partial release (iv) full release; and wherein each of said sections includes (a) a first counter and associated gates; (b) means responsive to said switches for initiating an up-count in said first counter when a key to which said section is coupled is partially depressed from a completely released state or when a key is partially released from a completely depressed state, and for terminating said up-count when said coupled key is completely depressed from a partially depressed state or when said coupled key is completely released from a partially released state; and (c) means responsive to the binary values of the terminated upcounts for causing the durations of various phases of tonal attack and decay to vary inversely with the rates of key depression and release.

5. An electronic transfer organ in accordance with claim 1, wherein said means responsive at least to said transferred spatial position information and said means responsive to said composite signals and said pair of amplitude-multiplication factors for generating sounds include: (a) digital-to-analog conversion means for generating tone frequency currents corresponding to said groups, (b) a pitch decoupler for each voice, each said pitch decoupler having a plurality of analog input channels sufficient to receive all tone frequency currents simultaneously generated, each said pitch decouplers having a first output channel, a second output channel, and a pair of binary multiplying-factor word-input channels for each said analog input channel which pair is adapted to apportion any tone frequency current delivered to said analog input channel between said output channels, as two output analog signals, (c) a first voice decoupler having a plurality of analog input channels each of which is connected to the first output channel of a different one of a plurality of pitch decouplers, and a second voice decoupler having a plurality of analog input channels each of which is connected to the second output channel of a different one of said plurality of pitch decouplers, each said voice decoupler having a first output channel, a second output channel, and a pair of binary multiplying-factor word-input channels for each said analog input channel which pair is adapted to apportion any tone frequency current delivered to said analog input channel between said output channels, as two output analog signals, (d) four amplifier-speaker systems, each having an input channel which is connected to a different output channel of a voice decoupler; (e) means for delivering said tone frequency currents respectively to said analog input channels of said pitch decouplers; (f) means for delivering said output analog signals from said first output channels respectively to said analog input channels of said first voice decoupler; and (g) means for delivering said output analog signals from said second output channels respectively to said analog input channels of said second voice decoupler.

6. An electronic transfer organ according to claim 1, including a presettable generator of tone frequency currents which are mistuned within a given mistune tolerance, said presettable generator comprising in combination a source of high frequency current and, within each said small memory, a first presettable counter, means for applying said high frequency current to said first counter as a first clock frequency, a second presettable counter, means for applying the output frequency current of said first counter to said second counter as a second clock frequency, means responsive to the depression of any key for temporarily presetting said first counter so that said second clock frequency is equal to the product of the number of words in said group and a note frequency which permissibly differs from said nominal pitch by an amount within said mistune tolerance, means responsive to said depression of said key for temporarily presetting said second counter to complete its recurrent counts at said note frequency, and means responsive to activation of any stop for enabling the successive binary output values of said second counter to address successively and repeatedly during each cycle of said note frequency said transferred group of binary words corresponding to said activated stop and said depressed key.

7. An electronic transfer organ according to claim 6, wherein said means for temporarily presetting said first counter includes at least one additional counter adapted continuously to increment or decrement the count rate of said first counter in selectable amounts and sequences, at selectable rates, and at selectable times, thereby altering said note frequency.

8. An electronic transfer organ according to claim 7, wherein said additional counter comprises (a) a preset counter to which an input word signifying the unaltered frequency of said second clock frequency is applied and from which an output word is delivered to said first counter to preset said first counter and (b) means for activating and deactivating said preset counter so that while activated it counts so that said output word differs from said input word by the amount of the count.

9. An electronic transfer organ according to claim 1, wherein each, said small memory includes (a) means for storing a group of binary words defining a waveform corresponding to a certain note, each word representing a relative amplitude of a point on said waveform, and (b) means for so modifying said series that said relative amplitudes are confined within an envelope having a sigmoid attack shape and a sigmoid decay shape, whose steepness is distinctive for each note, said modification means being adapted to multiply the value of successive binary digital words by a multiplication factor which rises from zero to a maximum at momentary rates which are first slow then rapid, then again slow, thereby constituting a sigmoid envelope of tonal attack, said modification means being also adapted to multiply the value of successive binary ditial words by a multiplication factor which declines from the said maximum to zero at momentary rates which are first slow, then rapid, then again slow, thereby constituting a sigmoid envelope of tonal decay, said modification means including means for enabling the overall steepness of the said signoid envelopes of tonal attack and decay to assume a distinctive value for each individual note.

10. Apparatus in accordance with claim 9, wherein said modification means comprises, in combination, a first, up-down, counter clocked at at least one presettable frequency, means for enabling the said counter first to count down from a maximum to zero and then to count up from zero to the said maximum during both active tonal attack and active tonal decay, said active tonal attack and said active tonal decay each having a first half and a second half, at rates determined by the said frequency, a second counter, means for applying the changing binary output words of said first counter as successive presetting values to said second counter, said second counter being thus preset by the said progressively declining and increasing binary word outputs of the said first counter, selectively enabled means for applying a constant maximum presetting signal to the said second counter, enabling it to maintain a continuing maximum count for sustaining a main tone fully on during the interval between the completion of its tonal attack and the inception of its tonal decay; a shift register, means for clocking said second counter and said shift register at a relatively high clock frequency, means for applying to a said shift register a series of binary words, each of which words corresponds to the relative amplitude of a point on a tone waveform, means for recurrently enabling, by pulses occuring at a frequency representing the arithmetical product of a tone frequency and the number of amplitude points on its waveform which suffice to define its audible harmonic frequencies, said second counter to count and said shift register to shift said successively applied waveform-amplitude-point binary words in shift sequences whose comprised numbers of steps are determined by the said successive, binary count values of the said first counter through its presettings of the second said counter; the said words so shifted being thus adapted to generate shift-register binary output signals each having an amplitude value which has a complement, said respective amplitude values first increasing from zero to a maximum then declining from the said maximum to zero during both active tonal attack and active tonal decay; a shift register adder; and means for causing said shift register adder to generate adder output signals whose respective amplitude values are equal to the increasing values of said shift-register putput signals during the first half of active tonal attack and the declining values of said shift-register output signals during the second half of tonal decay, the respective amplotude values of said adder output signals being equal to the sum of double the maximum binary value of said shift-register output signals and the successive complements of the increasing values of said shift-register output signals during the second half of tonal attack, and to the sum of double said maximum binary value and the successive complements of the decreasing binary values of said shift-register output signals during the first half of tonal decay, thereby generating adder output signals adapted to develop altogether sigmoid envelopes of tonal attack and tonal decay, and applying said adder output signals to further tone signal processing means.

11. Apparatus in accordance with claim 10, including means for presetting said first counter comprising a third counter (which is preset by the action of designating said designated group so as to generate a phase-duration-designating clock-frequency) and a fourth counter (which is preset by the speed of key depression or release and to which said phase-duration-designating clock frequency is applied), the output frequency of said fourth counter being applied to said first counter as a clock frequency.

12. An electronic transfer organ in accordance with claim 1 wherein each said individualized signal converted from temporarily-stored information by activation of a stop includes a latent attack signal, means responsive to said latent attack signal for generating an active attack signal at a presettable time interval after said latent attack signal, means for presetting said time interval, means responsive to said active attack signal for converting the words stored in the small memory corresponding to said activated stop and said depressed key into sound, means for causing complete release of said depressed key to produce a latent decay signal, means responsive to said latent decay signal for generating an active decay signal at a presettable time interval after said latent decay signal, means for presetting said time interval, and means responsive to said active decay signal for terminating said conversion into sound.

13. An electronic transfer organ according to claim 12, including a socket and alternative plugs for varying the effect of said key-state signals in timing the onsets of latent and active attack and decay.

14. An electronic transfer organ in accordance with claim 12 including means for generating a permanent clock frequency, a first counter presettable by said words to divide said permanent clock frequency by values predetermining individualized key-phase-durations characteristic of tones of various pitches and qualities; and including a second counter preset by key movement and clocked by the count output frequency of the said first counter, thereby producing small, randomly varying differences in the starting times of active attacks of pluralities of notes keyed by the same section, each of said notes having at least one frequency associated therewith, said differences constituting random phase-independence of the frequencies of the said notes.

15. An electronic transfer organ according to claim 12, including a multi-position switch for varying the effect of said key depression and key release in timing the onsets of latent and active, attack and decay.

* * * * *